US006923623B2

(12) United States Patent
Cleveland et al.

(10) Patent No.: US 6,923,623 B2
(45) Date of Patent: Aug. 2, 2005

(54) PERIMETER-COOLED TURBINE BUCKET AIRFOIL COOLING HOLE LOCATION, STYLE AND CONFIGURATION

(75) Inventors: Peter Gaines Cleveland, Greenville, SC (US); Thomas Bradley Beddard, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 57 days.

(21) Appl. No.: 10/635,435

(22) Filed: Aug. 7, 2003

(65) Prior Publication Data

US 2005/0031449 A1 Feb. 10, 2005

(51) Int. Cl.[7] ..... F01D 5/18
(52) U.S. Cl. ..... 416/97 R; 416/92; 416/DIG. 2
(58) Field of Search ..... 416/92, 96 R, 416/97 R; 415/115, DIG. 2

(56) References Cited

U.S. PATENT DOCUMENTS 5,980,209 A * 11/1999 Barry et al. ..... 416/97 R
6,382,914 B1 * 5/2002 Tressler ..... 416/97 R

* cited by examiner

*Primary Examiner*—Edward K. Look
*Assistant Examiner*—Richard A. Edgar
(74) *Attorney, Agent, or Firm*—Nixon & Vanderhye

(57) ABSTRACT

A turbine stage one bucket has an airfoil having a plurality of cooling holes passing through the airfoil from 0% span to 100% span whereby cooling air exits the airfoil tip into the hot gas path. X and Y coordinate values are given in Table I, locating the holes relative to the airfoil profile at airfoil profile sections of 5%, 50% and 90% span, Table I also giving the hole diameters. In this manner, cooling hole optimization for this turbine bucket airfoil is achieved. The cooling holes are also located in relation to the profile of the bucket airfoil given by the X, Y and Z coordinate values of Table II, the two coordinate systems having the same origin.

14 Claims, 7 Drawing Sheets

PERIMETER-COOLED TURBINE BUCKET AIRFOIL COOLING HOLE LOCATION, STYLE AND CONFIGURATION

BACKGROUND OF THE INVENTION

The present invention relates to an airfoil for a bucket of a stage of a gas turbine and particularly relates to a stage one bucket airfoil having an optimized number, location, style and size of perimetrically-arranged cooling holes for flowing a cooling medium, e.g., air, through the airfoil.

There are many different types and numbers of passages for flowing a cooling medium through an airfoil for cooling the airfoil. While the different cooling mediums may be used, many airfoils are air-cooled, It will be appreciated that the air used to cool gas turbine airfoils of this type is derived from the compressor and therefore results in a debit to the overall efficiency of the turbine. A prior cooling configuration for a bucket of a particular turbine did not sufficiently cool the bucket. Problems were associated with bulk creep and oxidation and a more effective cooling scheme which decreases the bulk temperature of the bucket and increases both the bucket's bulk creep life and oxidation life was deemed necessary. A further prior perimeter-cooled stage one bucket utilizes a perimeter cooling scheme. However, in the present turbine, this prior air-cooled bucket could not be utilized as it is not a direct scale regarding the size, location, style and number of cooling holes through the airfoil. Accordingly, there is a need to provide an optimized cooling scheme for a particular airfoil of a turbine bucket which utilizes a minimum amount of the cooling medium, e.g., air, and, hence, an increase in efficiency of the turbine, as well as a cooling scheme which will increase both bulk creep and oxidation life.

BRIEF DESCRIPTION OF THE INVENTION

In accordance with a preferred embodiment of the present invention, there is provided a bucket having an airfoil in which the number, location, style and size of the cooling holes or passages through the airfoil which convey the cooling medium increase the overall efficiency of the turbine and meet bucket life requirements. Particularly, there is provided an airfoil which has cooling holes which extend from the platform at 0% span to the airfoil tip at 100% span, with the cooling medium, preferably air, exiting the cooling holes at the tip through an opening in a tip flange for flow into the hot gas stream. The cooling holes are non-parallel to the radial axis of the airfoil and are preferably canted relative to one another to accommodate the airfoil curvature. While all of the cooling holes are preferably circular in cross-section, the cooling holes intermediate the leading edge cooling hole and a pair of cooling holes adjacent the trailing edge are turbulated to promote cooling. For example, in each of the intermediate cooling holes, annular ribs project into the cooling hole at spaced positions along its length to promote turbulence and, hence, cooling. It will be appreciated that other schemes for turbulation such as discrete protuberances or a roughening of the cooling hole walls to increase air turbulence may be utilized.

The cooling hole arrangement is of a perimetric configuration which enables the cooling holes to follow the general contours of the suction and pressure sides of the airfoil. It will be appreciated that optimization of airfoil cooling is a function of the number, size, style and location of the cooling holes. The number and size of the holes limit the magnitude of the air flow based on pressure differences across the bucket. The location determines the temperature of each finite element making up the airfoil. The style, i.e., smooth versus turbulated holes, effects the heat transfer characteristics of the cooling air along the walls of the cooling hole. Consequently, a highly specific optimized cooling hole design is provided.

Additionally, the hole diameter of the cooling passage is related to the location of the cooling passages in the bucket. More particularly, the locations and diameters of the cooling holes are related to the airfoil profile at various locations along the airfoil span. The airfoil profile is given by X, Y, Z coordinates in Table II below and in a companion U.S. patent application Ser. No. 10/616,911, filed Jul. 11, 2003 , now U.S. Pat. No. 6,769,879, the disclosure of which is incorporated herein by reference. By locating the cooling holes within the airfoil profile sections using X and Y coordinate values at Z locations, i.e., 5%, 50% and 90% span, the locations of the cooling passages are identified in the airfoil and relative to the suction and pressure sides of the airfoil.

More specifically, the location of the cooling passages is identified by X, Y and span coordinate values in a Cartesian coordinate system set forth in Table I below. The X and Y coordinates for the hole locations are given in distance dimensions, e.g., units of inches, and are given at 5%, 50% and 90% span locations. Consequently, an optimized cooling scheme for an airfoil of a turbine bucket is defined by the location of the cooling holes at various airfoil spans.

In a preferred embodiment according to the present invention, there is provided an air-cooled bucket for a turbine comprising an airfoil section having a plurality of cooling holes extending between root and tip portions of the airfoil with the holes exiting at the tip of the airfoil, the holes including at least a first hole adjacent a leading edge, at least a second hole adjacent a trailing edge and a plurality of holes intermediate the leading and trailing edge holes, the plurality of intermediate holes including holes spaced from one another on opposite sides of a mean camber line between the leading and trailing edges wherein the plurality of cooling holes form a generally airfoil-shaped envelope within the airfoil section, the first, intermediate and second holes having respective different cross-sectional areas with the first hole having the largest cross-sectional area, the intermediate holes having cross-sectional areas smaller than the cross-sectional area of the first hole and the second hole having a cross-sectional area smaller than the cross-sectional area of the intermediate holes.

In a further preferred embodiment according to the present invention, there is provided an air-cooled bucket for a turbine comprising an airfoil having a plurality of cooling holes extending between root and tip portions of the airfoil with the holes exiting at the tip of the airfoil, the holes including at least a first hole adjacent a leading edge, at least a second hole adjacent a trailing edge and a plurality of holes intermediate the leading and trailing edge holes, the plurality of intermediate holes including holes spaced from one another on opposite sides of a mean camber line between the leading and trailing edges wherein certain of the intermediate cooling holes form a generally airfoil-shaped envelope within and along the airfoil between the root and tip portions, the first, second and intermediate holes being located in accordance with X and Y coordinate values set forth in Table I in a plane passing through the root of the airfoil section at 5% span and wherein the first, second and intermediate holes correspond to holes numbered, H1, H16 and H2–H14, respectively.

In a further preferred embodiment according to the present invention, there is provided a turbine bucket including a bucket airfoil having an airfoil shape and a plurality of cooling holes extending between root and tip portions thereof, the airfoil having a nominal profile substantially in accordance with Cartesian coordinate values of X, Y and Z set forth in Table II wherein the Z values are non-dimensional values from 0.05 span to 0.95 span convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the holes including at least a first hole adjacent a leading edge, at least a second hole adjacent a trailing edge and a plurality of holes intermediate the leading and trailing edge holes, the plurality of intermediate holes including holes spaced from one another on opposite sides of a mean camber line between the leading and trailing edges wherein the plurality of cooling holes form a generally airfoil-shaped envelope within the airfoil section, the first, intermediate and second holes having respective different cross-sectional areas with the first hole having the largest cross-sectional area, the intermediate holes having cross-sectional areas smaller than the cross-sectional area of the first hole and the second hole having a cross-sectional area smaller than the cross-sectional area of the intermediate holes.

In a further preferred embodiment according to the present invention, there is provided a turbine bucket including a bucket airfoil having an airfoil shape and a plurality of cooling holes extending between root and tip portions thereof, the airfoil having a nominal profile substantially in accordance with Cartesian coordinate values of X, Y and Z set forth in Table II wherein the Z values are non-dimensional values from 0.05 span to 0.95 span convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the holes including at least a first hole adjacent a leading edge, at least a second hole adjacent a trailing edge and a plurality of holes intermediate the leading and trailing edge holes, the plurality of intermediate holes including holes spaced from one another on opposite sides of a mean camber line between the leading and trailing edges wherein certain of the intermediate cooling holes form a generally airfoil-shaped envelope within and along the airfoil between the root and tip portions, the first, second and intermediate holes being located in accordance with X and Y coordinate values set forth in Table I in a plane passing through the root of the airfoil section at 5% span and wherein the first, second and intermediate holes correspond to holes numbered, H1, H16 and H2–H14, respectively.

DETAILED DESCRIPTION OF THE INVENTION

Figure 1:
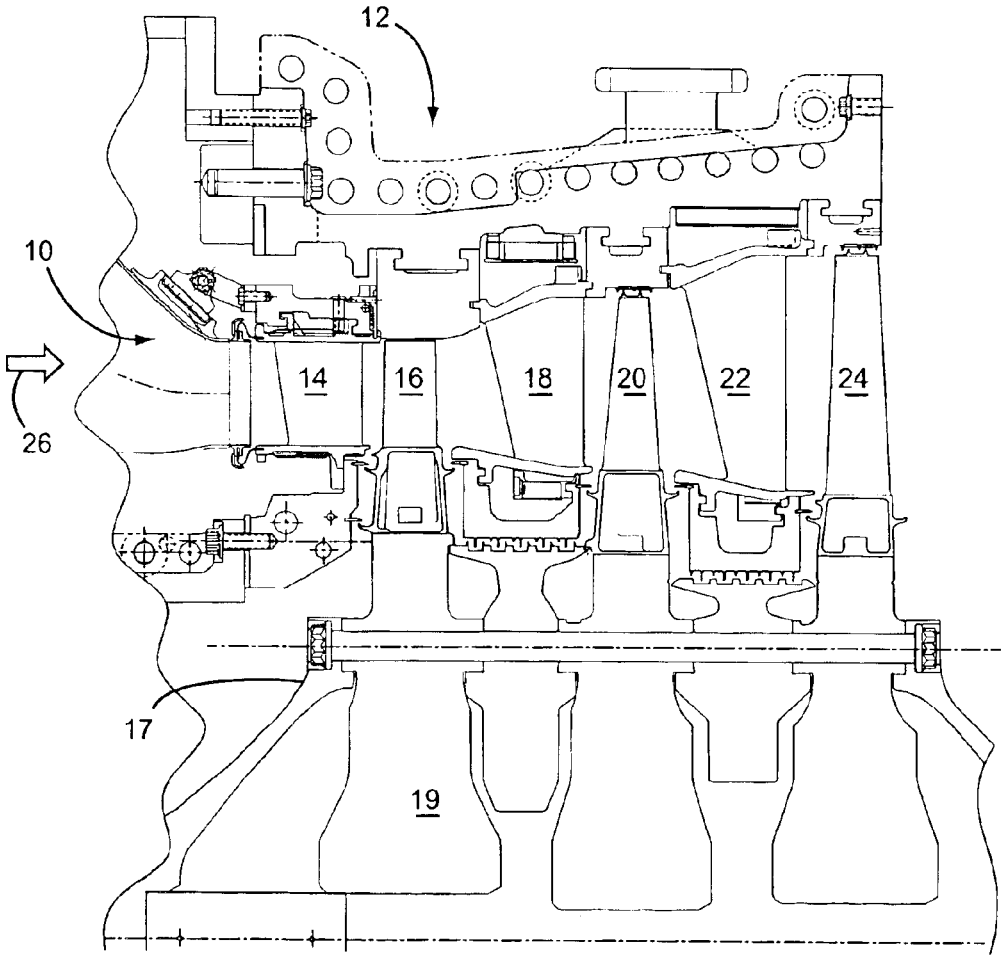
FIG. 1 is a schematic representation of a hot gas path through multiple stages of a gas turbine and illustrates a first stage bucket airfoil according to a preferred embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor 17. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 2:
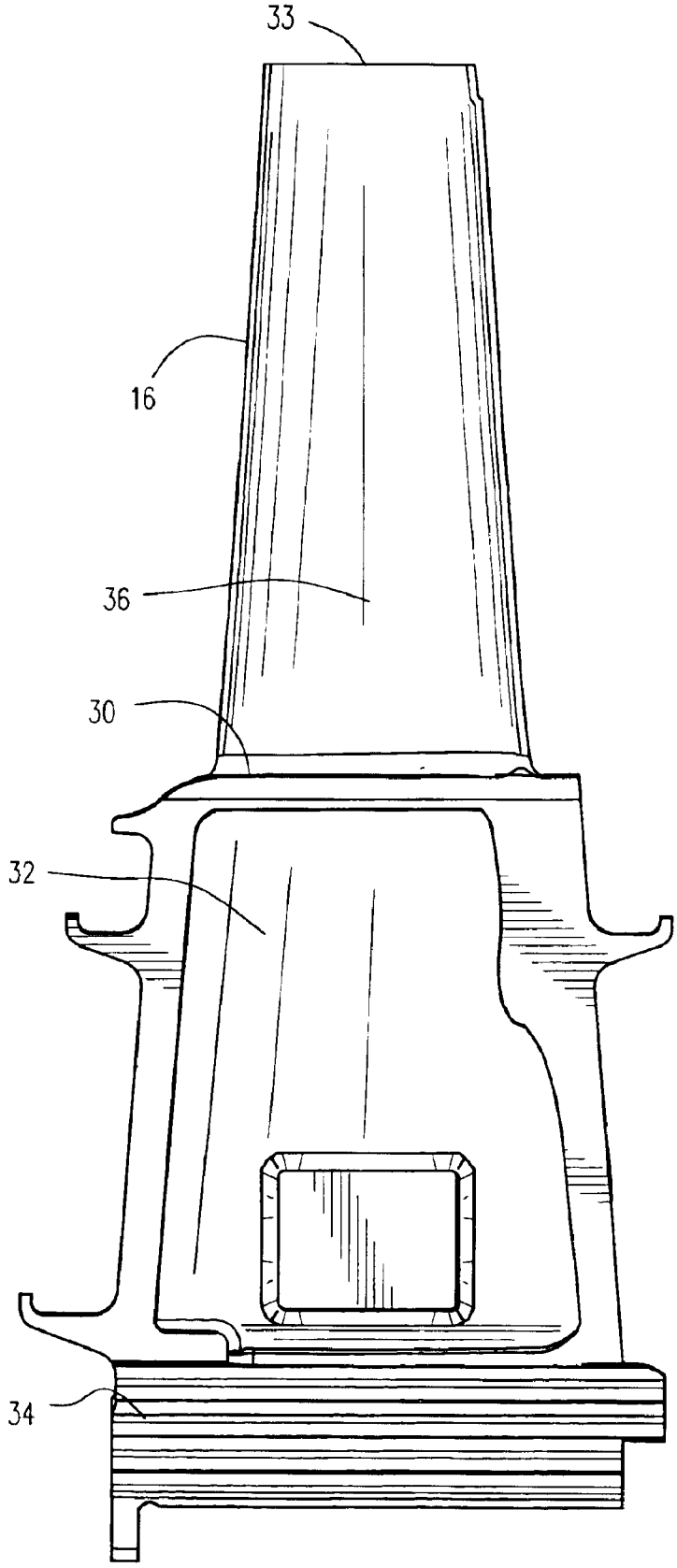
FIG. 2 is a side elevational view of a bucket illustrating the airfoil in accordance with a preferred embodiment of the present invention.
Figure 3:
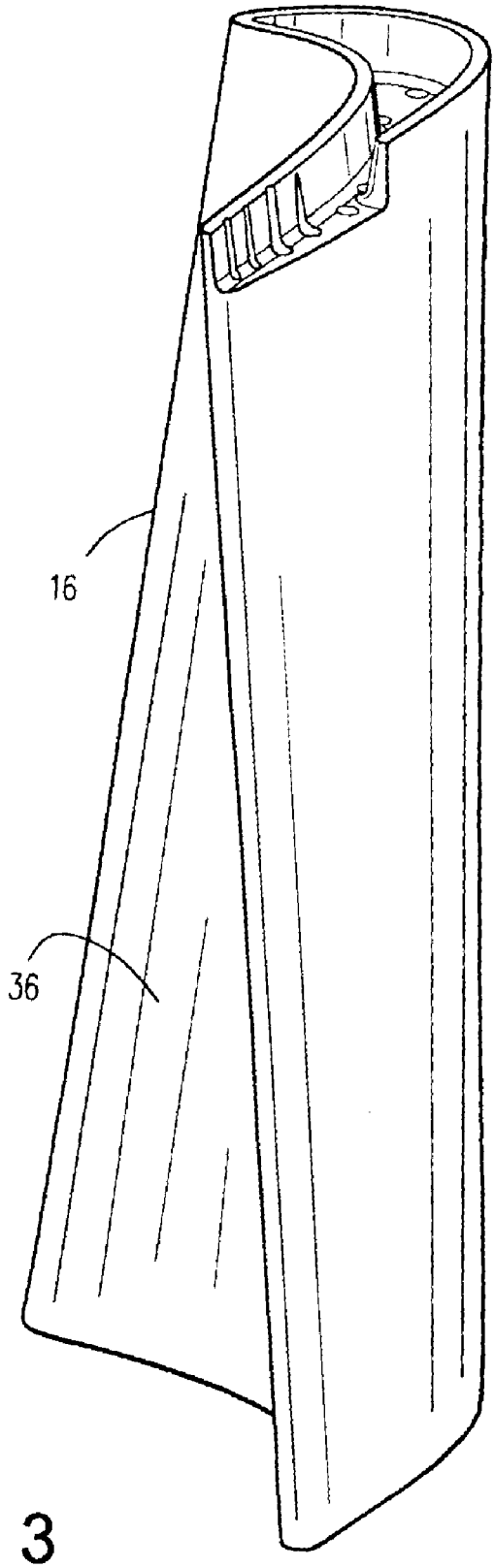
FIG. 3 is a perspective view of the airfoil of the bucket of FIG. 2.

It will be appreciated that the buckets, for example, the buckets 16 of the first stage are mounted on a rotor wheel 19 forming part of rotor 17. Each bucket 16 is provided, as illustrated in FIG. 2, with a platform 30, a shank 32 and an axial entry dovetail 34 for connection with a complementary-shaped mating dovetail, not shown, on the rotor wheel 19. It will also be appreciated that each bucket 16 has a bucket airfoil 36. Thus, each of the buckets 16 has an airfoil profile at any cross-section along the airfoil from the airfoil root to the bucket tip 33.

Figure 4:
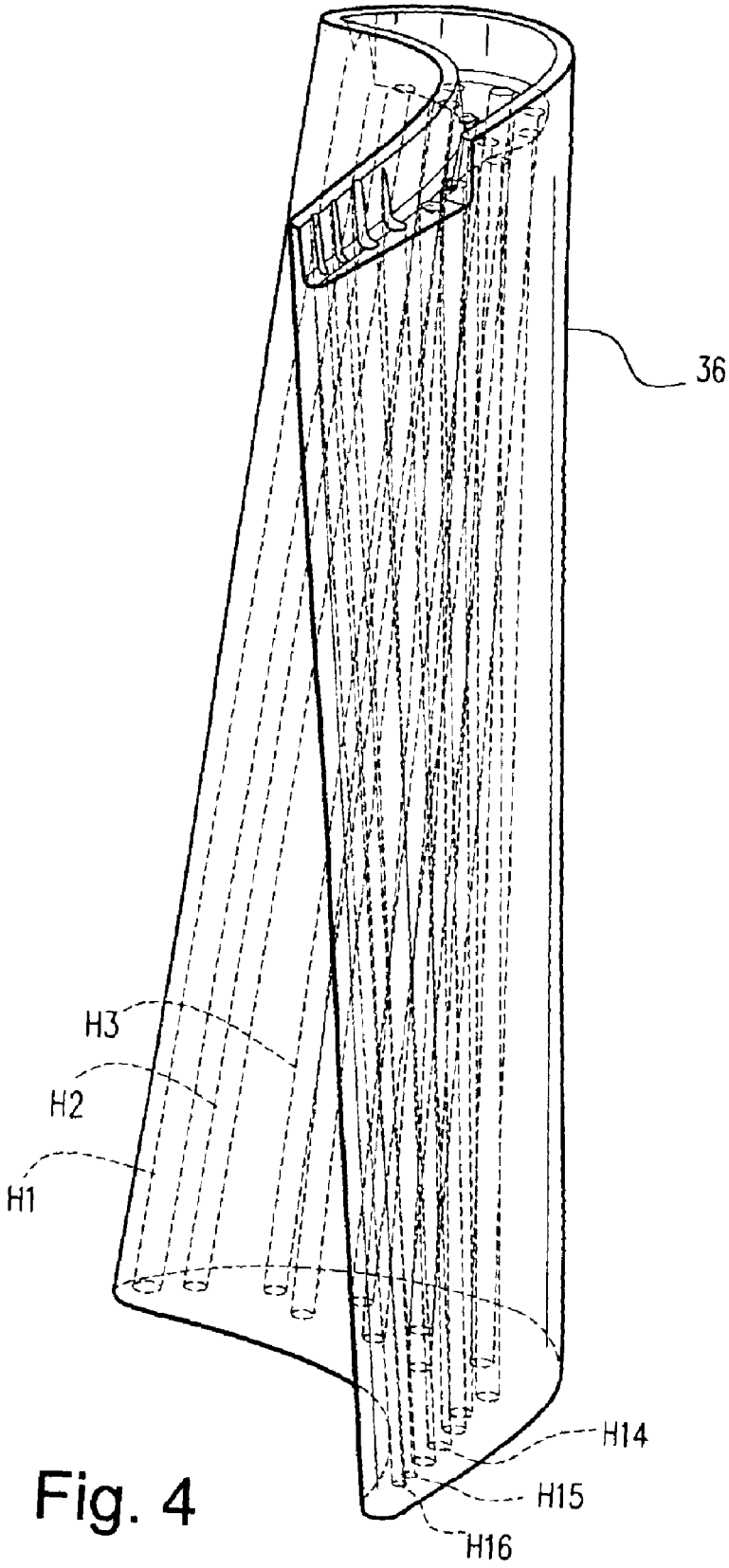
FIG. 4 is a perspective view of the airfoil with the internal cooling passages indicated by the dashed lines.
Figure 5:
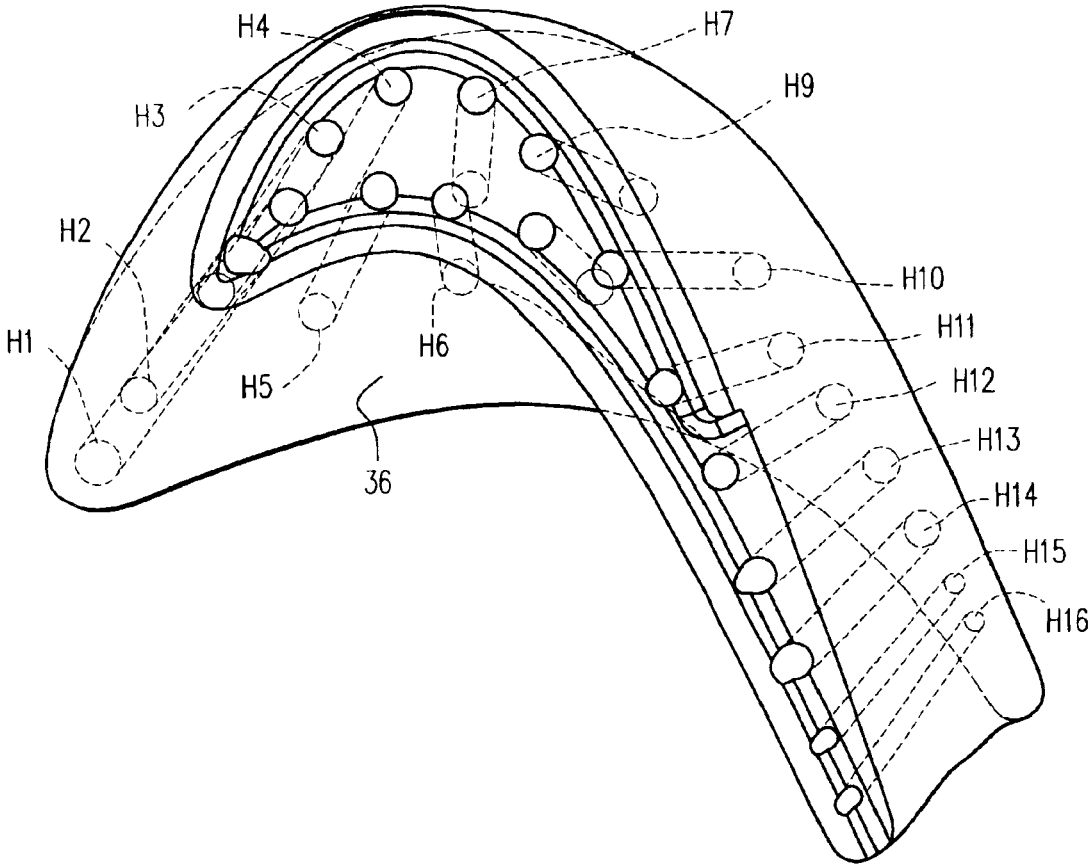
FIG. 5 is a radial end view of the airfoil illustrating the internal cooling passages in dashed lines.
Figure 6:
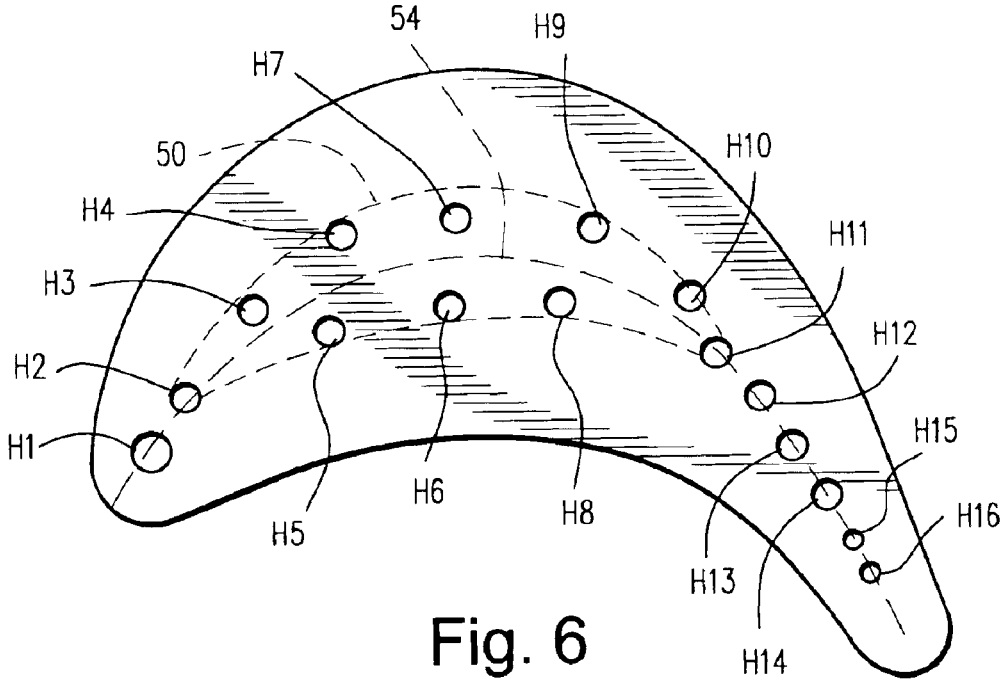
FIG. 6 is a cross-sectional view of the airfoil at 0% span illustrating the location of the cooling holes.

Referring particularly to FIGS. 4–7, the airfoil cooling holes are illustrated. For reference, the holes are designated in FIGS. 6 and 7 at 0% span and 100% span by the notation H followed by a hole number. Thus, as illustrated, there are sixteen cooling holes, designated H1–H16, with hole H1 at the leading edge and holes H15 and H16 adjacent the trailing edge. The intermediate holes are designated holes H2–H14. The holes extend from the shank 32 through airfoil 36 to the tip 33. All of the holes have circular cross-sectional configurations and, as illustrated in FIGS. 4 and 5, are canted relative to one another and to a radius from the engine centerline. As best illustrated in FIG. 6, the arrangement of the holes H1–H16 is perimetrical, i.e., essentially follows the contours of the pressure and suction sides of the airfoil while cooling hole diameters are constant throughout the length of each of the cooling holes. The hole diameter for hole H1, however, is larger than the hole diameters for holes H2–H16. The intermediate holes H2–H14 have a hole diameter in excess of the hole diameters of the trailing edge holes H15 and H16, all as indicated by the Table I below. Additionally, and referring to FIG. 8, the intermediate holes H2–H14 are turbulated. For example, as illustrated in FIG. 8, the holes H2–H14 each have a series of radially inwardly projecting ribs 42 at axially spaced positions along the length of the cooling hole to afford turbulence to the flow of air outwardly along the cooling hole. It will be appreciated that other forms of turbulence promoters, such as dimples or a roughened surface within the interior surfaces of the intermediate holes H2–H14 may be provided. The walls of the leading and trailing edge holes H1 and H15, H16, respectively, are smooth and are not turbulated.

Table I below provides the specific hole diameters and locations of the holes in an X, Y coordinate system at airfoil profile sections at 5% span, 50% span and 90% span. The origin of the X, Y coordinate system is the same origin used in the companion patent application identified above and incorporated by reference. By plotting the X, Y coordinates of each of the holes at the 5%, 50% and 90% spans and recognizing that the holes extend linearly, the precise location of the holes relative to the pressure and suction sides of the airfoil are given. Thus, it will be appreciated that the optimized cooling holes of the present airfoil are given in terms of their location and hole diameters set forth in Table I, as well as their orientation within the airfoil.

TABLE I

| Hole | Hole Diameter +/− 0005 from 0% Span to 100% Span (Inches) | 5% Span X (Inches) | 5% Span Y (Inches) | 50% Span X (Inches) | 50% Span Y (Inches) | 90% Span X (Inches) | 90% Span Y (Inches) |
|---|---|---|---|---|---|---|---|
| H1 | 0.142 | −1.308 | −0.386 | −1.083 | −0.078 | −0.883 | 0.195 |
| H2 | 0.113 | −1.178 | −0.180 | −0.946 | 0.105 | −0.740 | 0.359 |
| H3 | 0.113 | −0.940 | 0.134 | −0.771 | 0.367 | −0.621 | 0.575 |
| H4 | 0.113 | −0.635 | 0.066 | −0.539 | 0.250 | −0.453 | 0.413 |
| H5 | 0.113 | −0.595 | 0.412 | −0.494 | 0.585 | −0.404 | 0.740 |
| H6 | 0.113 | −0.198 | 0.167 | −0.213 | 0.282 | −0.226 | 0.385 |
| H7 | 0.113 | −0.164 | 0.437 | −0.151 | 0.582 | −0.140 | 0.711 |
| H8 | 0.113 | 0.209 | 0.131 | 0.121 | 0.217 | 0.044 | 0.298 |
| H9 | 0.113 | 0.342 | 0.408 | 0.192 | 0.477 | 0.059 | 0.537 |
| H10 | 0.113 | 0.683 | 0.173 | 0.468 | 0.177 | 0.277 | 0.180 |
| H11 | 0.113 | 0.784 | −0.074 | 0.600 | −0.130 | 0.437 | −0.180 |
| H12 | 0.113 | 0.932 | −0.236 | 0.757 | −0.343 | 0.601 | −0.437 |
| H13 | 0.113 | 1.071 | −0.437 | 0.882 | −0.604 | 0.714 | −0.752 |
| H14 | 0.113 | 1.194 | −0.634 | 0.999 | −0.836 | 0.825 | −1.015 |
| H15 | 0.064 | 1.294 | −0.805 | 1.097 | −1.041 | 0.922 | −1.251 |
| H16 | 0.064 | 1.355 | −0.922 | 1.164 | −1.190 | 0.998 | −1.428 |

Figure 7:
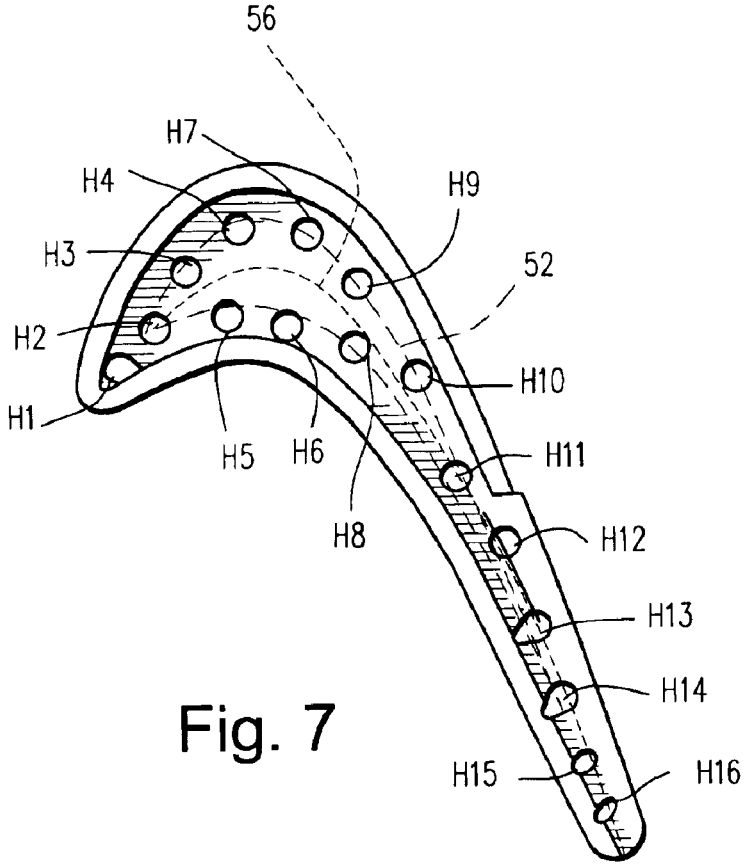
FIG. 7 is a radial end view at 100% span illustrating the exit openings of the cooling holes.
Figure 8:
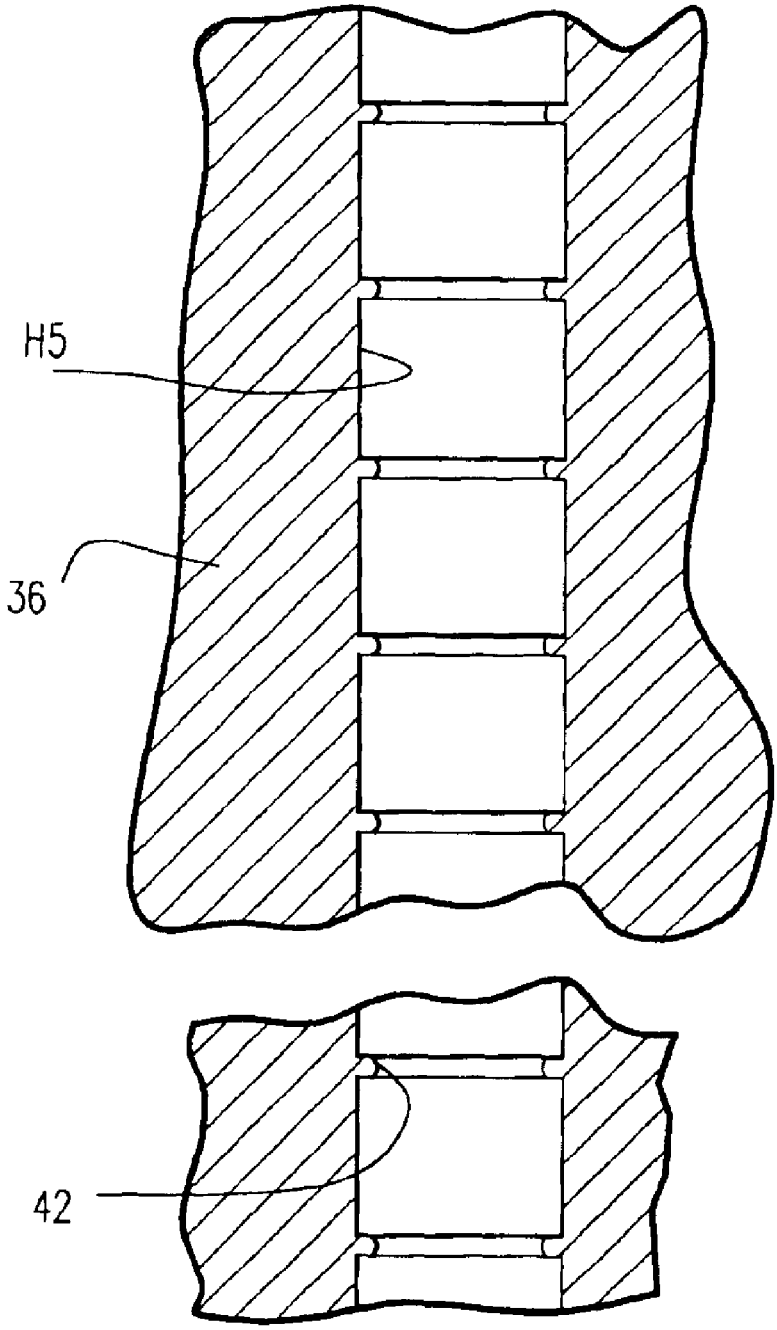
FIG. 8 is an enlarged fragmentary cross-sectional view illustrating the annular ribs forming turbulated cooling passages for the intermediate cooling holes.

From a review of FIGS. 6 and 7, it will be appreciated that certain holes define an envelope having an airfoil shape within the airfoil 36. Particularly, holes H3–H11 form a generally airfoil-shaped envelope 50 in FIG. 6 at 0% span of the airfoil whereas holes H2–H11 form a generally airfoil-shaped envelope 52 at 100% span. From a review of FIGS. 6 and 7, both envelopes 50 and 52 are defined by holes on opposite sides of mean camber lines 54 and 56, respectively, extending between leading and trailing edges of the airfoil.

To define the location of the cooling holes H1–H16 relative to the airfoil 36, the airfoil shape of each first stage bucket airfoil is given a unique set or loci of points in space. The loci of points are arrived at by iteration between aerodynamic and mechanical loadings enabling the turbine to run in an efficient, safe and smooth manner. The loci which defines the bucket airfoil profile comprises a set of 1000 points relative to the axis of rotation of the turbine. A Cartesian coordinate system of X, Y and Z values given in Table II below defines the profile section of the bucket airfoil at various locations along its length. The coordinate values for the X and Y coordinates are set forth in inches in Table II although other units of dimensions may be used when the values are appropriately converted. The Z values are set forth in Table II in non-dimensional form from 0.05 (5%) span to 0.95 (95% span). To convert the Z value to a Z coordinate value, e.g., in inches, the non-dimensional Z value given in Table II is multiplied by the height of the airfoil 36 in inches. The Cartesian coordinate system has orthogonally-related X, Y and Z axes and the X axis lies parallel to the turbine rotor centerline, i.e., the rotary axis and a positive X coordinate value is axial toward the aft, i.e., exhaust end of the turbine. The positive Y coordinate value looking aft extends tangentially in the direction of rotation of the rotor and the positive Z coordinate value is generally radially outwardly toward the bucket tip. The origins of the Cartesian coordinate systems of Tables I and II are coincident.

By defining X and Y coordinate values at selected locations in a Z direction normal to the X, Y plane, the bucket airfoil profile section at each Z distance along the length of the airfoil can be ascertained. By connecting the X and Y values with smooth continuing arcs, each profile section at each distance Z is fixed. The airfoil profile sections of the various surface locations between the distances Z are determined by smoothly connecting the adjacent profile sections to one another to form the entire airfoil profile. These values represent the airfoil profile sections at ambient, non-operating or non-hot conditions and are for an uncoated airfoil.

The Table II values for X and Y are generated and shown to four decimal places for determining the profile of the airfoil. The fourth decimal place, however, is not significant and may be rounded up or down. There are typical manufacturing tolerances as well as coatings which must be accounted for in the actual profile of the airfoil. Accordingly, the values for the airfoil profile given in Table II are for a nominal airfoil. It will therefore be appreciated that ± typical manufacturing tolerances, i.e., ± values, including any coating thicknesses, are additive to the X and Y values given in Table II below. Accordingly, a distance of ±0.150 inches in a direction normal to any surface location along the airfoil profile defines an airfoil profile envelope for this particular bucket airfoil design and turbine, i.e., a range of variation between measured points on the actual airfoil surface at nominal cold or room temperature and the ideal position of those points as given in the Table below at the same temperature. The bucket airfoil design is robust to this range of variation without impairment of mechanical and aerodynamic functions.

The coordinate values given in Table II below provide the preferred nominal profile envelope.

TABLE II

| X Inches | Y Inches | Z % Span |
|---|---|---|
| −1.3594 | −0.5213 | 0.05 |
| −1.2754 | −0.5233 | 0.05 |
| −1.1942 | −0.4993 | 0.05 |
| −1.1157 | −0.4673 | 0.05 |
| −1.0376 | −0.4344 | 0.05 |
| −0.9588 | −0.4030 | 0.05 |
| −0.8792 | −0.3740 | 0.05 |
| −0.7987 | −0.3474 | 0.05 |
| −0.7176 | −0.3227 | 0.05 |
| −0.6361 | −0.2995 | 0.05 |
| −0.5541 | −0.2782 | 0.05 |
| −0.4715 | −0.2592 | 0.05 |
| −0.3883 | −0.2431 | 0.05 |
| −0.3045 | −0.2302 | 0.05 |
| −0.2202 | −0.2208 | 0.05 |
| −0.1357 | −0.2155 | 0.05 |
| −0.0509 | −0.2144 | 0.05 |
| 0.0338 | −0.2180 | 0.05 |
| 0.1181 | −0.2264 | 0.05 |
| 0.2018 | −0.2399 | 0.05 |
| 0.2845 | −0.2583 | 0.05 |
| 0.3659 | −0.2818 | 0.05 |
| 0.4458 | −0.3101 | 0.05 |
| 0.5239 | −0.3430 | 0.05 |
| 0.6000 | −0.3804 | 0.05 |
| 0.6738 | −0.4220 | 0.05 |
| 0.7453 | −0.4675 | 0.05 |
| 0.8144 | −0.5166 | 0.05 |
| 0.8810 | −0.5691 | 0.05 |
| 0.9450 | −0.6246 | 0.05 |
| 1.0066 | −0.6829 | 0.05 |
| 1.0656 | −0.7436 | 0.05 |
| 1.1223 | −0.8067 | 0.05 |
| 1.1766 | −0.8717 | 0.05 |
| 1.2287 | −0.9386 | 0.05 |
| 1.2787 | −1.0071 | 0.05 |
| 1.3272 | −1.0766 | 0.05 |
| 1.3746 | −1.1468 | 0.05 |
| 1.4284 | −1.2110 | 0.05 |
| 1.5101 | −1.2115 | 0.05 |
| 1.5576 | −1.1449 | 0.05 |
| 1.5383 | −1.0633 | 0.05 |
| 1.5074 | −0.9843 | 0.05 |
| 1.4748 | −0.9061 | 0.05 |
| 1.4417 | −0.8280 | 0.05 |
| 1.4085 | −0.7501 | 0.05 |
| 1.3750 | −0.6722 | 0.05 |
| 1.3414 | −0.5944 | 0.05 |
| 1.3074 | −0.5167 | 0.05 |
| 1.2731 | −0.4392 | 0.05 |
| 1.2383 | −0.3619 | 0.05 |
| 1.2030 | −0.2849 | 0.05 |
| 1.1671 | −0.2081 | 0.05 |
| 1.0930 | −0.0556 | 0.05 |
| 1.1305 | −0.1316 | 0.05 |
| 1.0547 | 0.0200 | 0.05 |
| 1.0154 | 0.0951 | 0.05 |
| 0.9747 | 0.1695 | 0.05 |
| 0.9324 | 0.2429 | 0.05 |
| 0.8884 | 0.3154 | 0.05 |
| 0.8423 | 0.3865 | 0.05 |
| 0.7935 | 0.4558 | 0.05 |
| 0.7415 | 0.5227 | 0.05 |
| 0.6860 | 0.5867 | 0.05 |
| 0.6266 | 0.6472 | 0.05 |
| 0.5633 | 0.7035 | 0.05 |
| 0.4959 | 0.7550 | 0.05 |
| 0.4248 | 0.8010 | 0.05 |
| 0.3501 | 0.8410 | 0.05 |
| 0.2723 | 0.8746 | 0.05 |
| 0.1920 | 0.9018 | 0.05 |
| 0.1098 | 0.9222 | 0.05 |
| 0.0261 | 0.9358 | 0.05 |
| −0.0583 | 0.9426 | 0.05 |
| −0.1431 | 0.9427 | 0.05 |
| −0.2276 | 0.9363 | 0.05 |

TABLE II-continued

| X Inches | Y Inches | Z % Span |
|---|---|---|
| −0.3113 | 0.9233 | 0.05 |
| −0.3938 | 0.9039 | 0.05 |
| −0.4746 | 0.8782 | 0.05 |
| −0.5531 | 0.8463 | 0.05 |
| −0.6290 | 0.8087 | 0.05 |
| −0.7021 | 0.7658 | 0.05 |
| −0.7721 | 0.7180 | 0.05 |
| −0.8390 | 0.6659 | 0.05 |
| −0.9027 | 0.6101 | 0.05 |
| −0.9634 | 0.5509 | 0.05 |
| −1.0211 | 0.4888 | 0.05 |
| −1.0761 | 0.4243 | 0.05 |
| −1.1285 | 0.3577 | 0.05 |
| −1.1785 | 0.2893 | 0.05 |
| −1.2260 | 0.2191 | 0.05 |
| −1.2708 | 0.1471 | 0.05 |
| −1.3123 | 0.0732 | 0.05 |
| −1.3505 | −0.0025 | 0.05 |
| −1.3853 | −0.0797 | 0.05 |
| −1.4161 | −0.1587 | 0.05 |
| −1.4419 | −0.2394 | 0.05 |
| −1.4602 | −0.3221 | 0.05 |
| −1.4647 | −0.4066 | 0.05 |
| −1.4348 | −0.4840 | 0.05 |
| −1.3488 | −0.4782 | 0.10 |
| −1.2655 | −0.4832 | 0.10 |
| −1.1852 | −0.4582 | 0.10 |
| −1.1085 | −0.4232 | 0.10 |
| −1.0323 | −0.3872 | 0.10 |
| −0.9553 | −0.3530 | 0.10 |
| −0.8769 | −0.3219 | 0.10 |
| −0.7974 | −0.2941 | 0.10 |
| −0.7168 | −0.2694 | 0.10 |
| −0.6356 | −0.2468 | 0.10 |
| −0.5538 | −0.2266 | 0.10 |
| −0.4713 | −0.2090 | 0.10 |
| −0.3883 | −0.1946 | 0.10 |
| −0.3047 | −0.1839 | 0.10 |
| −0.2207 | −0.1771 | 0.10 |
| −0.1364 | −0.1747 | 0.10 |
| −0.0522 | −0.1770 | 0.10 |
| 0.0318 | −0.1842 | 0.10 |
| 0.1151 | −0.1966 | 0.10 |
| 0.1976 | −0.2143 | 0.10 |
| 0.2787 | −0.2370 | 0.10 |
| 0.3583 | −0.2647 | 0.10 |
| 0.4360 | −0.2973 | 0.10 |
| 0.5117 | −0.3344 | 0.10 |
| 0.5852 | −0.3757 | 0.10 |
| 0.6563 | −0.4209 | 0.10 |
| 0.7250 | −0.4697 | 0.10 |
| 0.7913 | −0.5217 | 0.10 |
| 0.8552 | −0.5767 | 0.10 |
| 0.9167 | −0.6343 | 0.10 |
| 0.9759 | −0.6943 | 0.10 |
| 1.0329 | −0.7564 | 0.10 |
| 1.0877 | −0.8205 | 0.10 |
| 1.1404 | −0.8862 | 0.10 |
| 1.1912 | −0.9535 | 0.10 |
| 1.2402 | −1.0221 | 0.10 |
| 1.2880 | −1.0915 | 0.10 |
| 1.3356 | −1.1611 | 0.10 |
| 1.3903 | −1.2240 | 0.10 |
| 1.4715 | −1.2246 | 0.10 |
| 1.5193 | −1.1588 | 0.10 |
| 1.5020 | −1.0771 | 0.10 |
| 1.4727 | −0.9981 | 0.10 |
| 1.4409 | −0.9200 | 0.10 |
| 1.4085 | −0.8422 | 0.10 |
| 1.3760 | −0.7644 | 0.10 |
| 1.3434 | −0.6867 | 0.10 |
| 1.3105 | −0.6091 | 0.10 |
| 1.2775 | −0.5315 | 0.10 |
| 1.2441 | −0.4541 | 0.10 |
| 1.2103 | −0.3769 | 0.10 |
| 1.1760 | −0.2999 | 0.10 |

TABLE II-continued

| X Inches | Y Inches | Z % Span |
|---|---|---|
| 1.1412 | −0.2232 | 0.10 |
| 1.1057 | −0.1467 | 0.10 |
| 1.0695 | −0.0706 | 0.10 |
| 1.0324 | 0.0051 | 0.10 |
| 0.9944 | 0.0803 | 0.10 |
| 0.9550 | 0.1549 | 0.10 |
| 0.9141 | 0.2286 | 0.10 |
| 0.8715 | 0.3013 | 0.10 |
| 0.8268 | 0.3728 | 0.10 |
| 0.7795 | 0.4425 | 0.10 |
| 0.7291 | 0.5101 | 0.10 |
| 0.6755 | 0.5751 | 0.10 |
| 0.6183 | 0.6370 | 0.10 |
| 0.5575 | 0.6954 | 0.10 |
| 0.4930 | 0.7496 | 0.10 |
| 0.4248 | 0.7991 | 0.10 |
| 0.3530 | 0.8432 | 0.10 |
| 0.2779 | 0.8815 | 0.10 |
| 0.2000 | 0.9137 | 0.10 |
| 0.1198 | 0.9394 | 0.10 |
| 0.0376 | 0.9580 | 0.10 |
| −0.0459 | 0.9696 | 0.10 |
| −0.1300 | 0.9741 | 0.10 |
| −0.2142 | 0.9716 | 0.10 |
| −0.2980 | 0.9622 | 0.10 |
| −0.3806 | 0.9458 | 0.10 |
| −0.4617 | 0.9228 | 0.10 |
| −0.5406 | 0.8932 | 0.10 |
| −0.6170 | 0.8576 | 0.10 |
| −0.6904 | 0.8163 | 0.10 |
| −0.7607 | 0.7698 | 0.10 |
| −0.8278 | 0.7188 | 0.10 |
| −0.8915 | 0.6636 | 0.10 |
| −0.9519 | 0.6049 | 0.10 |
| −1.0092 | 0.5430 | 0.10 |
| −1.0635 | 0.4786 | 0.10 |
| −1.1150 | 0.4118 | 0.10 |
| −1.1638 | 0.3431 | 0.10 |
| −1.2101 | 0.2727 | 0.10 |
| −1.2538 | 0.2006 | 0.10 |
| −1.2940 | 0.1265 | 0.10 |
| −1.3305 | 0.0506 | 0.10 |
| −1.3636 | −0.0269 | 0.10 |
| −1.3928 | −0.1060 | 0.10 |
| −1.4171 | −0.1867 | 0.10 |
| −1.4344 | −0.2692 | 0.10 |
| −1.4398 | −0.3531 | 0.10 |
| −1.4182 | −0.4330 | 0.10 |
| −1.2786 | −0.4146 | 0.20 |
| −1.1966 | −0.4068 | 0.20 |
| −1.1203 | −0.3739 | 0.20 |
| −1.0475 | −0.3337 | 0.20 |
| −0.9748 | −0.2933 | 0.20 |
| −0.9008 | −0.2553 | 0.20 |
| −0.8252 | −0.2207 | 0.20 |
| −0.7479 | −0.1901 | 0.20 |
| −0.6692 | −0.1633 | 0.20 |
| −0.5894 | −0.1400 | 0.20 |
| −0.5087 | −0.1199 | 0.20 |
| −0.4271 | −0.1036 | 0.20 |
| −0.3448 | −0.0919 | 0.20 |
| −0.2619 | −0.0852 | 0.20 |
| −0.1788 | −0.0840 | 0.20 |
| −0.0958 | −0.0887 | 0.20 |
| −0.0133 | −0.0994 | 0.20 |
| 0.0682 | −0.1161 | 0.20 |
| 0.1482 | −0.1387 | 0.20 |
| 0.2264 | −0.1668 | 0.20 |
| 0.3026 | −0.2001 | 0.20 |
| 0.3766 | −0.2380 | 0.20 |
| 0.4483 | −0.2801 | 0.20 |
| 0.5176 | −0.3262 | 0.20 |
| 0.5844 | −0.3757 | 0.20 |
| 0.6488 | −0.4282 | 0.20 |
| 0.7110 | −0.4834 | 0.20 |
| 0.7710 | −0.5411 | 0.20 |

TABLE II-continued

| X Inches | Y Inches | Z % Span |
|---|---|---|
| 0.8288 | −0.6008 | 0.20 |
| 0.8847 | −0.6624 | 0.20 |
| 0.9386 | −0.7257 | 0.20 |
| 0.9908 | −0.7905 | 0.20 |
| 1.0413 | −0.8565 | 0.20 |
| 1.0903 | −0.9237 | 0.20 |
| 1.1378 | −0.9920 | 0.20 |
| 1.1839 | −1.0612 | 0.20 |
| 1.2291 | −1.1310 | 0.20 |
| 1.2754 | −1.2001 | 0.20 |
| 1.3309 | −1.2610 | 0.20 |
| 1.4112 | −1.2619 | 0.20 |
| 1.4594 | −1.1977 | 0.20 |
| 1.4454 | −1.1164 | 0.20 |
| 1.4178 | −1.0380 | 0.20 |
| 1.3872 | −0.9606 | 0.20 |
| 1.3558 | −0.8836 | 0.20 |
| 1.3241 | −0.8067 | 0.20 |
| 1.2924 | −0.7299 | 0.20 |
| 1.2604 | −0.6531 | 0.20 |
| 1.2282 | −0.5764 | 0.20 |
| 1.1956 | −0.4999 | 0.20 |
| 1.1626 | −0.4235 | 0.20 |
| 1.1292 | −0.3474 | 0.20 |
| 1.0953 | −0.2715 | 0.20 |
| 1.0607 | −0.1958 | 0.20 |
| 1.0255 | −0.1205 | 0.20 |
| 0.9895 | −0.0455 | 0.20 |
| 0.9526 | 0.0290 | 0.20 |
| 0.9145 | 0.1030 | 0.20 |
| 0.8752 | 0.1762 | 0.20 |
| 0.8344 | 0.2487 | 0.20 |
| 0.7918 | 0.3201 | 0.20 |
| 0.7471 | 0.3902 | 0.20 |
| 0.6998 | 0.4587 | 0.20 |
| 0.6499 | 0.5251 | 0.20 |
| 0.5970 | 0.5894 | 0.20 |
| 0.5410 | 0.6508 | 0.20 |
| 0.4815 | 0.7089 | 0.20 |
| 0.4184 | 0.7630 | 0.20 |
| 0.3517 | 0.8126 | 0.20 |
| 0.2815 | 0.8572 | 0.20 |
| 0.2080 | 0.8962 | 0.20 |
| 0.1315 | 0.9287 | 0.20 |
| 0.0524 | 0.9543 | 0.20 |
| −0.0287 | 0.9724 | 0.20 |
| −0.1112 | 0.9830 | 0.20 |
| −0.1943 | 0.9861 | 0.20 |
| −0.2773 | 0.9817 | 0.20 |
| −0.3596 | 0.9700 | 0.20 |
| −0.4406 | 0.9513 | 0.20 |
| −0.5197 | 0.9257 | 0.20 |
| −0.5964 | 0.8937 | 0.20 |
| −0.6703 | 0.8556 | 0.20 |
| −0.7410 | 0.8118 | 0.20 |
| −0.8082 | 0.7629 | 0.20 |
| −0.8719 | 0.7094 | 0.20 |
| −0.9319 | 0.6518 | 0.20 |
| −0.9883 | 0.5907 | 0.20 |
| −1.0414 | 0.5267 | 0.20 |
| −1.0912 | 0.4601 | 0.20 |
| −1.1380 | 0.3914 | 0.20 |
| −1.1822 | 0.3210 | 0.20 |
| −1.2235 | 0.2488 | 0.20 |
| −1.2609 | 0.1745 | 0.20 |
| −1.2944 | 0.0984 | 0.20 |
| −1.3242 | 0.0208 | 0.20 |
| −1.3498 | −0.0584 | 0.20 |
| −1.3702 | −0.1390 | 0.20 |
| −1.3830 | −0.2211 | 0.20 |
| −1.3829 | −0.3041 | 0.20 |
| −1.3527 | −0.3803 | 0.20 |
| −1.2750 | −0.3356 | 0.30 |
| −1.1951 | −0.3497 | 0.30 |
| −1.1168 | −0.3255 | 0.30 |
| −1.0448 | −0.2858 | 0.30 |

TABLE II-continued

| X Inches | Y Inches | Z % Span |
|---|---|---|
| −0.9748 | −0.2427 | 0.30 |
| −0.9043 | −0.2004 | 0.30 |
| −0.8322 | −0.1608 | 0.30 |
| −0.7582 | −0.1249 | 0.30 |
| −0.6823 | −0.0932 | 0.30 |
| −0.6048 | −0.0657 | 0.30 |
| −0.5260 | −0.0423 | 0.30 |
| −0.4459 | −0.0233 | 0.30 |
| −0.3648 | −0.0097 | 0.30 |
| −0.2830 | −0.0020 | 0.30 |
| −0.2007 | −0.0011 | 0.30 |
| −0.1187 | −0.0072 | 0.30 |
| −0.0376 | −0.0205 | 0.30 |
| 0.0421 | −0.0409 | 0.30 |
| 0.1197 | −0.0679 | 0.30 |
| 0.1950 | −0.1009 | 0.30 |
| 0.2677 | −0.1394 | 0.30 |
| 0.3377 | −0.1826 | 0.30 |
| 0.4051 | −0.2297 | 0.30 |
| 0.4699 | −0.2804 | 0.30 |
| 0.5322 | −0.3341 | 0.30 |
| 0.5922 | −0.3904 | 0.30 |
| 0.6499 | −0.4489 | 0.30 |
| 0.7057 | −0.5094 | 0.30 |
| 0.7596 | −0.5715 | 0.30 |
| 0.8118 | −0.6351 | 0.30 |
| 0.8624 | −0.6999 | 0.30 |
| 0.9115 | −0.7659 | 0.30 |
| 0.9593 | −0.8328 | 0.30 |
| 1.0059 | −0.9006 | 0.30 |
| 1.0514 | −0.9691 | 0.30 |
| 1.0957 | −1.0384 | 0.30 |
| 1.1392 | −1.1083 | 0.30 |
| 1.1826 | −1.1781 | 0.30 |
| 1.2273 | −1.2472 | 0.30 |
| 1.2810 | −1.3082 | 0.30 |
| 1.3604 | −1.3096 | 0.30 |
| 1.4090 | −1.2467 | 0.30 |
| 1.3961 | −1.1662 | 0.30 |
| 1.3700 | −1.0882 | 0.30 |
| 1.3402 | −1.0115 | 0.30 |
| 1.3094 | −0.9352 | 0.30 |
| 1.2784 | −0.8591 | 0.30 |
| 1.2472 | −0.7830 | 0.30 |
| 1.2157 | −0.7070 | 0.30 |
| 1.1840 | −0.6311 | 0.30 |
| 1.1518 | −0.5554 | 0.30 |
| 1.1193 | −0.4798 | 0.30 |
| 1.0864 | −0.4044 | 0.30 |
| 1.0530 | −0.3293 | 0.30 |
| 1.0190 | −0.2544 | 0.30 |
| 0.9844 | −0.1798 | 0.30 |
| 0.9491 | −0.1055 | 0.30 |
| 0.9130 | −0.0316 | 0.30 |
| 0.8759 | 0.0419 | 0.30 |
| 0.7986 | 0.1871 | 0.30 |
| 0.8378 | 0.1148 | 0.30 |
| 0.7580 | 0.2586 | 0.30 |
| 0.7157 | 0.3291 | 0.30 |
| 0.6715 | 0.3985 | 0.30 |
| 0.6251 | 0.4664 | 0.30 |
| 0.5762 | 0.5325 | 0.30 |
| 0.5245 | 0.5965 | 0.30 |
| 0.4696 | 0.6578 | 0.30 |
| 0.4113 | 0.7157 | 0.30 |
| 0.3493 | 0.7698 | 0.30 |
| 0.2838 | 0.8195 | 0.30 |
| 0.2147 | 0.8641 | 0.30 |
| 0.1422 | 0.9028 | 0.30 |
| 0.0664 | 0.9347 | 0.30 |
| −0.0121 | 0.9592 | 0.30 |
| −0.0925 | 0.9762 | 0.30 |
| −0.1742 | 0.9854 | 0.30 |
| −0.2564 | 0.9868 | 0.30 |
| −0.3384 | 0.9803 | 0.30 |
| −0.4194 | 0.9663 | 0.30 |

TABLE II-continued

| X Inches | Y Inches | Z % Span |
|---|---|---|
| −0.4988 | 0.9448 | 0.30 |
| −0.5759 | 0.9162 | 0.30 |
| −0.6501 | 0.8808 | 0.30 |
| −0.7209 | 0.8390 | 0.30 |
| −0.7880 | 0.7915 | 0.30 |
| −0.8512 | 0.7389 | 0.30 |
| −0.9105 | 0.6818 | 0.30 |
| −0.9658 | 0.6210 | 0.30 |
| −1.0175 | 0.5570 | 0.30 |
| −1.0657 | 0.4903 | 0.30 |
| −1.1107 | 0.4215 | 0.30 |
| −1.1531 | 0.3511 | 0.30 |
| −1.1922 | 0.2787 | 0.30 |
| −1.2272 | 0.2043 | 0.30 |
| −1.2583 | 0.1282 | 0.30 |
| −1.2855 | 0.0505 | 0.30 |
| −1.3081 | −0.0285 | 0.30 |
| −1.3249 | −0.1090 | 0.30 |
| −1.3326 | −0.1909 | 0.30 |
| −1.3236 | −0.2723 | 0.30 |
| −1.2050 | −0.2886 | 0.40 |
| −1.1248 | −0.2873 | 0.40 |
| −1.0503 | −0.2554 | 0.40 |
| −0.9807 | −0.2135 | 0.40 |
| −0.9123 | −0.1698 | 0.40 |
| −0.8431 | −0.1272 | 0.40 |
| −0.7723 | −0.0874 | 0.40 |
| −0.6996 | −0.0513 | 0.40 |
| −0.6250 | −0.0192 | 0.40 |
| −0.5486 | 0.0085 | 0.40 |
| −0.4707 | 0.0314 | 0.40 |
| −0.3913 | 0.0484 | 0.40 |
| −0.3108 | 0.0585 | 0.40 |
| −0.2296 | 0.0608 | 0.40 |
| −0.1486 | 0.0548 | 0.40 |
| −0.0688 | 0.0403 | 0.40 |
| 0.0093 | 0.0178 | 0.40 |
| 0.0848 | −0.0119 | 0.40 |
| 0.1575 | −0.0481 | 0.40 |
| 0.2271 | −0.0899 | 0.40 |
| 0.2937 | −0.1364 | 0.40 |
| 0.3574 | −0.1867 | 0.40 |
| 0.4185 | −0.2403 | 0.40 |
| 0.4770 | −0.2966 | 0.40 |
| 0.5332 | −0.3552 | 0.40 |
| 0.5873 | −0.4158 | 0.40 |
| 0.6396 | −0.4779 | 0.40 |
| 0.6902 | −0.5415 | 0.40 |
| 0.7393 | −0.6062 | 0.40 |
| 0.7870 | −0.6719 | 0.40 |
| 0.8334 | −0.7386 | 0.40 |
| 0.8788 | −0.8060 | 0.40 |
| 0.9231 | −0.8740 | 0.40 |
| 0.9665 | −0.9427 | 0.40 |
| 1.0091 | −1.0118 | 0.40 |
| 1.0510 | −1.0814 | 0.40 |
| 1.0921 | −1.1514 | 0.40 |
| 1.1335 | −1.2213 | 0.40 |
| 1.1765 | −1.2902 | 0.40 |
| 1.2295 | −1.3506 | 0.40 |
| 1.3079 | −1.3522 | 0.40 |
| 1.3566 | −1.2906 | 0.40 |
| 1.3452 | −1.2109 | 0.40 |
| 1.3202 | −1.1336 | 0.40 |
| 1.2913 | −1.0577 | 0.40 |
| 1.2613 | −0.9822 | 0.40 |
| 1.2310 | −0.9069 | 0.40 |
| 1.2006 | −0.8316 | 0.40 |
| 1.1699 | −0.7564 | 0.40 |
| 1.1389 | −0.6813 | 0.40 |
| 1.1075 | −0.6064 | 0.40 |
| 1.0758 | −0.5316 | 0.40 |
| 1.0437 | −0.4570 | 0.40 |
| 1.0111 | −0.3826 | 0.40 |
| 0.9781 | −0.3084 | 0.40 |
| 0.9444 | −0.2345 | 0.40 |

TABLE II-continued

| X Inches | Y Inches | Z % Span |
|---|---|---|
| 0.9101 | −0.1608 | 0.40 |
| 0.8752 | −0.0875 | 0.40 |
| 0.8394 | −0.0146 | 0.40 |
| 0.8028 | 0.0579 | 0.40 |
| 0.7653 | 0.1299 | 0.40 |
| 0.7266 | 0.2014 | 0.40 |
| 0.6866 | 0.2720 | 0.40 |
| 0.6450 | 0.3418 | 0.40 |
| 0.6016 | 0.4105 | 0.40 |
| 0.5562 | 0.4778 | 0.40 |
| 0.5084 | 0.5434 | 0.40 |
| 0.4576 | 0.6068 | 0.40 |
| 0.4037 | 0.6676 | 0.40 |
| 0.3465 | 0.7252 | 0.40 |
| 0.2858 | 0.7792 | 0.40 |
| 0.2216 | 0.8289 | 0.40 |
| 0.1537 | 0.8735 | 0.40 |
| 0.0822 | 0.9119 | 0.40 |
| 0.0075 | 0.9436 | 0.40 |
| −0.0700 | 0.9680 | 0.40 |
| −0.1495 | 0.9844 | 0.40 |
| −0.2303 | 0.9924 | 0.40 |
| −0.3115 | 0.9918 | 0.40 |
| −0.3921 | 0.9825 | 0.40 |
| −0.4713 | 0.9645 | 0.40 |
| −0.5481 | 0.9382 | 0.40 |
| −0.6217 | 0.9041 | 0.40 |
| −0.6917 | 0.8629 | 0.40 |
| −0.7577 | 0.8156 | 0.40 |
| −0.8195 | 0.7629 | 0.40 |
| −0.8772 | 0.7057 | 0.40 |
| −0.9309 | 0.6448 | 0.40 |
| −0.9809 | 0.5809 | 0.40 |
| −1.0276 | 0.5144 | 0.40 |
| −1.0713 | 0.4459 | 0.40 |
| −1.1124 | 0.3759 | 0.40 |
| −1.1503 | 0.3041 | 0.40 |
| −1.1845 | 0.2304 | 0.40 |
| −1.2149 | 0.1551 | 0.40 |
| −1.2413 | 0.0783 | 0.40 |
| −1.2629 | 0.0000 | 0.40 |
| −1.2782 | −0.0797 | 0.40 |
| −1.2830 | −0.1607 | 0.40 |
| −1.2663 | −0.2396 | 0.40 |
| −1.2115 | −0.2017 | 0.50 |
| −1.1425 | −0.2377 | 0.50 |
| −1.0641 | −0.2257 | 0.50 |
| −0.9921 | −0.1906 | 0.50 |
| −0.9239 | −0.1487 | 0.50 |
| −0.8562 | −0.1058 | 0.50 |
| −0.7877 | −0.0642 | 0.50 |
| −0.7176 | −0.0254 | 0.50 |
| −0.6456 | 0.0098 | 0.50 |
| −0.5718 | 0.0409 | 0.50 |
| −0.4962 | 0.0674 | 0.50 |
| −0.4188 | 0.0880 | 0.50 |
| −0.3398 | 0.1013 | 0.50 |
| −0.2599 | 0.1061 | 0.50 |
| −0.1800 | 0.1014 | 0.50 |
| −0.1012 | 0.0871 | 0.50 |
| −0.0246 | 0.0636 | 0.50 |
| 0.0490 | 0.0321 | 0.50 |
| 0.1193 | −0.0063 | 0.50 |
| 0.1862 | −0.0505 | 0.50 |
| 0.2497 | −0.0992 | 0.50 |
| 0.3102 | −0.1518 | 0.50 |
| 0.3679 | −0.2074 | 0.50 |
| 0.4231 | −0.2654 | 0.50 |
| 0.4761 | −0.3255 | 0.50 |
| 0.5271 | −0.3873 | 0.50 |
| 0.5764 | −0.4505 | 0.50 |
| 0.6241 | −0.5149 | 0.50 |
| 0.6704 | −0.5803 | 0.50 |
| 0.7155 | −0.6465 | 0.50 |
| 0.7595 | −0.7135 | 0.50 |
| 0.8025 | −0.7811 | 0.50 |

TABLE II-continued

| X Inches | Y Inches | Z % Span |
|---|---|---|
| 0.8446 | −0.8492 | 0.50 |
| 0.8860 | −0.9178 | 0.50 |
| 0.9267 | −0.9868 | 0.50 |
| 0.9669 | −1.0562 | 0.50 |
| 1.0065 | −1.1258 | 0.50 |
| 1.0456 | −1.1958 | 0.50 |
| 1.0851 | −1.2655 | 0.50 |
| 1.1263 | −1.3342 | 0.50 |
| 1.1782 | −1.3939 | 0.50 |
| 1.2556 | −1.3956 | 0.50 |
| 1.3044 | −1.3354 | 0.50 |
| 1.2942 | −1.2566 | 0.50 |
| 1.2701 | −1.1802 | 0.50 |
| 1.2424 | −1.1050 | 0.50 |
| 1.2133 | −1.0304 | 0.50 |
| 1.1840 | −0.9558 | 0.50 |
| 1.1546 | −0.8813 | 0.50 |
| 1.1249 | −0.8069 | 0.50 |
| 1.0950 | −0.7325 | 0.50 |
| 1.0647 | −0.6583 | 0.50 |
| 1.0341 | −0.5843 | 0.50 |
| 1.0032 | −0.5104 | 0.50 |
| 0.9718 | −0.4366 | 0.50 |
| 0.9400 | −0.3631 | 0.50 |
| 0.9077 | −0.2898 | 0.50 |
| 0.8748 | −0.2167 | 0.50 |
| 0.8413 | −0.1439 | 0.50 |
| 0.8072 | −0.0714 | 0.50 |
| 0.7723 | 0.0007 | 0.50 |
| 0.7365 | 0.0724 | 0.50 |
| 0.6998 | 0.1436 | 0.50 |
| 0.6619 | 0.2142 | 0.50 |
| 0.6227 | 0.2841 | 0.50 |
| 0.5821 | 0.3531 | 0.50 |
| 0.5397 | 0.4212 | 0.50 |
| 0.4954 | 0.4879 | 0.50 |
| 0.4485 | 0.5529 | 0.50 |
| 0.3989 | 0.6158 | 0.50 |
| 0.3464 | 0.6763 | 0.50 |
| 0.2908 | 0.7340 | 0.50 |
| 0.2318 | 0.7882 | 0.50 |
| 0.1692 | 0.8382 | 0.50 |
| 0.1028 | 0.8830 | 0.50 |
| 0.0328 | 0.9218 | 0.50 |
| −0.0407 | 0.9537 | 0.50 |
| −0.1171 | 0.9777 | 0.50 |
| −0.1958 | 0.9928 | 0.50 |
| −0.2757 | 0.9985 | 0.50 |
| −0.3556 | 0.9943 | 0.50 |
| −0.4344 | 0.9801 | 0.50 |
| −0.5109 | 0.9564 | 0.50 |
| −0.5842 | 0.9240 | 0.50 |
| −0.6535 | 0.8839 | 0.50 |
| −0.7186 | 0.8372 | 0.50 |
| −0.7794 | 0.7850 | 0.50 |
| −0.8360 | 0.7284 | 0.50 |
| −0.8887 | 0.6680 | 0.50 |
| −0.9378 | 0.6047 | 0.50 |
| −0.9836 | 0.5390 | 0.50 |
| −1.0265 | 0.4713 | 0.50 |
| −1.0670 | 0.4022 | 0.50 |
| −1.1046 | 0.3314 | 0.50 |
| −1.1389 | 0.2590 | 0.50 |
| −1.1695 | 0.1850 | 0.50 |
| −1.1961 | 0.1094 | 0.50 |
| −1.2178 | 0.0323 | 0.50 |
| −1.2325 | −0.0464 | 0.50 |
| −1.2355 | −0.1264 | 0.50 |
| −1.1511 | −0.1583 | 0.60 |
| −1.0760 | −0.1775 | 0.60 |
| −1.0003 | −0.1557 | 0.60 |
| −0.9305 | −0.1185 | 0.60 |
| −0.8631 | −0.0771 | 0.60 |
| −0.7956 | −0.0358 | 0.60 |
| −0.7269 | 0.0035 | 0.60 |
| −0.6565 | 0.0395 | 0.60 |

TABLE II-continued

| X Inches | Y Inches | Z % Span |
|---|---|---|
| −0.5841 | 0.0715 | 0.60 |
| −0.5099 | 0.0990 | 0.60 |
| −0.4339 | 0.1208 | 0.60 |
| −0.3562 | 0.1355 | 0.60 |
| −0.2773 | 0.1413 | 0.60 |
| −0.1983 | 0.1372 | 0.60 |
| −0.1206 | 0.1228 | 0.60 |
| −0.0453 | 0.0985 | 0.60 |
| 0.0266 | 0.0655 | 0.60 |
| 0.0947 | 0.0254 | 0.60 |
| 0.1591 | −0.0206 | 0.60 |
| 0.2199 | −0.0712 | 0.60 |
| 0.2775 | −0.1255 | 0.60 |
| 0.3321 | −0.1827 | 0.60 |
| 0.3843 | −0.2422 | 0.60 |
| 0.4343 | −0.3036 | 0.60 |
| 0.4823 | −0.3665 | 0.60 |
| 0.5285 | −0.4307 | 0.60 |
| 0.5733 | −0.4959 | 0.60 |
| 0.6168 | −0.5620 | 0.60 |
| 0.6591 | −0.6289 | 0.60 |
| 0.7004 | −0.6964 | 0.60 |
| 0.7408 | −0.7644 | 0.60 |
| 0.7804 | −0.8329 | 0.60 |
| 0.8193 | −0.9018 | 0.60 |
| 0.8577 | −0.9710 | 0.60 |
| 0.8956 | −1.0405 | 0.60 |
| 0.9330 | −1.1102 | 0.60 |
| 0.9701 | −1.1801 | 0.60 |
| 1.0069 | −1.2502 | 0.60 |
| 1.0442 | −1.3200 | 0.60 |
| 1.0832 | −1.3888 | 0.60 |
| 1.1330 | −1.4488 | 0.60 |
| 1.2095 | −1.4510 | 0.60 |
| 1.2585 | −1.3921 | 0.60 |
| 1.2494 | −1.3143 | 0.60 |
| 1.2258 | −1.2388 | 0.60 |
| 1.1991 | −1.1643 | 0.60 |
| 1.1711 | −1.0903 | 0.60 |
| 1.1430 | −1.0163 | 0.60 |
| 1.1146 | −0.9424 | 0.60 |
| 1.0861 | −0.8686 | 0.60 |
| 1.0573 | −0.7949 | 0.60 |
| 1.0283 | −0.7213 | 0.60 |
| 0.9990 | −0.6478 | 0.60 |
| 0.9693 | −0.5744 | 0.60 |
| 0.9393 | −0.5012 | 0.60 |
| 0.9089 | −0.4282 | 0.60 |
| 0.8780 | −0.3553 | 0.60 |
| 0.8467 | −0.2826 | 0.60 |
| 0.8147 | −0.2102 | 0.60 |
| 0.7822 | −0.1381 | 0.60 |
| 0.7491 | −0.0663 | 0.60 |
| 0.7152 | 0.0053 | 0.60 |
| 0.6804 | 0.0764 | 0.60 |
| 0.6447 | 0.1470 | 0.60 |
| 0.6078 | 0.2170 | 0.60 |
| 0.5698 | 0.2864 | 0.60 |
| 0.5304 | 0.3550 | 0.60 |
| 0.4892 | 0.4226 | 0.60 |
| 0.4461 | 0.4889 | 0.60 |
| 0.4006 | 0.5536 | 0.60 |
| 0.3525 | 0.6165 | 0.60 |
| 0.3017 | 0.6771 | 0.60 |
| 0.2478 | 0.7351 | 0.60 |
| 0.1904 | 0.7895 | 0.60 |
| 0.1292 | 0.8396 | 0.60 |
| 0.0640 | 0.8845 | 0.60 |
| −0.0050 | 0.9231 | 0.60 |
| −0.0777 | 0.9541 | 0.60 |
| −0.1536 | 0.9766 | 0.60 |
| −0.2316 | 0.9893 | 0.60 |
| −0.3107 | 0.9917 | 0.60 |
| −0.3893 | 0.9834 | 0.60 |
| −0.4662 | 0.9649 | 0.60 |
| −0.5401 | 0.9368 | 0.60 |

TABLE II-continued

| X Inches | Y Inches | Z % Span |
|---|---|---|
| −0.6103 | 0.9003 | 0.60 |
| −0.6762 | 0.8566 | 0.60 |
| −0.7377 | 0.8069 | 0.60 |
| −0.7948 | 0.7522 | 0.60 |
| −0.8479 | 0.6934 | 0.60 |
| −0.8971 | 0.6315 | 0.60 |
| −0.9429 | 0.5670 | 0.60 |
| −0.9857 | 0.5004 | 0.60 |
| −1.0257 | 0.4322 | 0.60 |
| −1.0630 | 0.3624 | 0.60 |
| −1.0971 | 0.2910 | 0.60 |
| −1.1275 | 0.2179 | 0.60 |
| −1.1537 | 0.1433 | 0.60 |
| −1.1748 | 0.0670 | 0.60 |
| −1.1880 | −0.0109 | 0.60 |
| −1.1870 | −0.0898 | 0.60 |
| −1.0894 | −0.1069 | 0.70 |
| −1.0127 | −0.1117 | 0.70 |
| −0.9399 | −0.0839 | 0.70 |
| −0.8715 | −0.0461 | 0.70 |
| −0.8044 | −0.0061 | 0.70 |
| −0.7366 | 0.0327 | 0.70 |
| −0.6672 | 0.0686 | 0.70 |
| −0.5958 | 0.1003 | 0.70 |
| −0.5225 | 0.1273 | 0.70 |
| −0.4473 | 0.1486 | 0.70 |
| −0.3705 | 0.1628 | 0.70 |
| −0.2926 | 0.1682 | 0.70 |
| −0.2147 | 0.1635 | 0.70 |
| −0.1382 | 0.1481 | 0.70 |
| −0.0644 | 0.1226 | 0.70 |
| 0.0058 | 0.0882 | 0.70 |
| 0.0718 | 0.0466 | 0.70 |
| 0.1339 | −0.0008 | 0.70 |
| 0.1923 | −0.0527 | 0.70 |
| 0.2473 | −0.1082 | 0.70 |
| 0.2994 | −0.1665 | 0.70 |
| 0.3489 | −0.2270 | 0.70 |
| 0.3961 | −0.2892 | 0.70 |
| 0.4415 | −0.3528 | 0.70 |
| 0.4851 | −0.4176 | 0.70 |
| 0.5273 | −0.4834 | 0.70 |
| 0.5681 | −0.5500 | 0.70 |
| 0.6079 | −0.6172 | 0.70 |
| 0.6467 | −0.6851 | 0.70 |
| 0.6846 | −0.7534 | 0.70 |
| 0.7218 | −0.8221 | 0.70 |
| 0.7584 | −0.8911 | 0.70 |
| 0.7945 | −0.9605 | 0.70 |
| 0.8301 | −1.0300 | 0.70 |
| 0.8654 | −1.0997 | 0.70 |
| 0.9003 | −1.1696 | 0.70 |
| 0.9351 | −1.2396 | 0.70 |
| 0.9698 | −1.3096 | 0.70 |
| 1.0050 | −1.3794 | 0.70 |
| 1.0415 | −1.4484 | 0.70 |
| 1.0900 | −1.5081 | 0.70 |
| 1.1654 | −1.5109 | 0.70 |
| 1.2142 | −1.4531 | 0.70 |
| 1.2060 | −1.3763 | 0.70 |
| 1.1831 | −1.3016 | 0.70 |
| 1.1573 | −1.2278 | 0.70 |
| 1.1305 | −1.1544 | 0.70 |
| 1.1036 | −1.0811 | 0.70 |
| 1.0765 | −1.0078 | 0.70 |
| 1.0492 | −0.9346 | 0.70 |
| 1.0217 | −0.8615 | 0.70 |
| 0.9939 | −0.7884 | 0.70 |
| 0.9659 | −0.7155 | 0.70 |
| 0.9377 | −0.6426 | 0.70 |
| 0.9090 | −0.5699 | 0.70 |
| 0.8801 | −0.4974 | 0.70 |
| 0.8507 | −0.4250 | 0.70 |
| 0.8209 | −0.3527 | 0.70 |
| 0.7906 | −0.2807 | 0.70 |
| 0.7598 | −0.2089 | 0.70 |

TABLE II-continued

| X Inches | Y Inches | Z % Span |
|---|---|---|
| 0.7284 | −0.1373 | 0.70 |
| 0.6964 | −0.0661 | 0.70 |
| 0.6636 | 0.0049 | 0.70 |
| 0.6300 | 0.0754 | 0.70 |
| 0.5955 | 0.1455 | 0.70 |
| 0.5600 | 0.2151 | 0.70 |
| 0.5233 | 0.2841 | 0.70 |
| 0.4852 | 0.3523 | 0.70 |
| 0.4455 | 0.4196 | 0.70 |
| 0.4038 | 0.4857 | 0.70 |
| 0.3599 | 0.5503 | 0.70 |
| 0.3137 | 0.6133 | 0.70 |
| 0.2646 | 0.6741 | 0.70 |
| 0.2122 | 0.7321 | 0.70 |
| 0.1562 | 0.7865 | 0.70 |
| 0.0962 | 0.8366 | 0.70 |
| 0.0321 | 0.8812 | 0.70 |
| −0.0362 | 0.9191 | 0.70 |
| −0.1083 | 0.9490 | 0.70 |
| −0.1836 | 0.9696 | 0.70 |
| −0.2610 | 0.9799 | 0.70 |
| −0.3391 | 0.9793 | 0.70 |
| −0.4163 | 0.9679 | 0.70 |
| −0.4913 | 0.9462 | 0.70 |
| −0.5630 | 0.9152 | 0.70 |
| −0.6306 | 0.8760 | 0.70 |
| −0.6936 | 0.8300 | 0.70 |
| −0.7521 | 0.7782 | 0.70 |
| −0.8062 | 0.7218 | 0.70 |
| −0.8562 | 0.6618 | 0.70 |
| −0.9024 | 0.5988 | 0.70 |
| −0.9452 | 0.5334 | 0.70 |
| −0.9849 | 0.4661 | 0.70 |
| −1.0219 | 0.3973 | 0.70 |
| −1.0558 | 0.3269 | 0.70 |
| −1.0859 | 0.2548 | 0.70 |
| −1.1117 | 0.1811 | 0.70 |
| −1.1320 | 0.1057 | 0.70 |
| −1.1435 | 0.0284 | 0.70 |
| −1.1377 | −0.0491 | 0.70 |
| −1.0375 | −0.0483 | 0.80 |
| −0.9616 | −0.0453 | 0.80 |
| −0.8907 | −0.0156 | 0.80 |
| −0.8232 | 0.0215 | 0.80 |
| −0.7561 | 0.0594 | 0.80 |
| −0.6878 | 0.0950 | 0.80 |
| −0.6176 | 0.1266 | 0.80 |
| −0.5452 | 0.1531 | 0.80 |
| −0.4710 | 0.1735 | 0.80 |
| −0.3951 | 0.1866 | 0.80 |
| −0.3183 | 0.1906 | 0.80 |
| −0.2416 | 0.1842 | 0.80 |
| −0.1666 | 0.1671 | 0.80 |
| −0.0946 | 0.1398 | 0.80 |
| −0.0265 | 0.1038 | 0.80 |
| 0.0372 | 0.0606 | 0.80 |
| 0.0969 | 0.0119 | 0.80 |
| 0.1527 | −0.0411 | 0.80 |
| 0.2053 | −0.0974 | 0.80 |
| 0.2550 | −0.1563 | 0.80 |
| 0.3021 | −0.2172 | 0.80 |
| 0.3471 | −0.2797 | 0.80 |
| 0.3903 | −0.3435 | 0.80 |
| 0.4318 | −0.4083 | 0.80 |
| 0.4719 | −0.4741 | 0.80 |
| 0.5108 | −0.5406 | 0.80 |
| 0.5487 | −0.6076 | 0.80 |
| 0.5856 | −0.6752 | 0.80 |
| 0.6218 | −0.7432 | 0.80 |
| 0.6573 | −0.8116 | 0.80 |
| 0.6922 | −0.8803 | 0.80 |
| 0.7266 | −0.9492 | 0.80 |
| 0.7606 | −1.0183 | 0.80 |
| 0.7944 | −1.0875 | 0.80 |
| 0.8279 | −1.1569 | 0.80 |
| 0.8612 | −1.2263 | 0.80 |

TABLE II-continued

| X Inches | Y Inches | Z % Span |
|---|---|---|
| 0.8944 | −1.2958 | 0.80 |
| 0.9277 | −1.3653 | 0.80 |
| 0.9615 | −1.4345 | 0.80 |
| 0.9966 | −1.5030 | 0.80 |
| 1.0441 | −1.5620 | 0.80 |
| 1.1186 | −1.5651 | 0.80 |
| 1.1664 | −1.5079 | 0.80 |
| 1.1602 | −1.4322 | 0.80 |
| 1.1374 | −1.3586 | 0.80 |
| 1.1126 | −1.2857 | 0.80 |
| 1.0870 | −1.2131 | 0.80 |
| 1.0612 | −1.1405 | 0.80 |
| 1.0354 | −1.0679 | 0.80 |
| 1.0093 | −0.9954 | 0.80 |
| 0.9831 | −0.9230 | 0.80 |
| 0.9567 | −0.8507 | 0.80 |
| 0.9301 | −0.7784 | 0.80 |
| 0.9032 | −0.7062 | 0.80 |
| 0.8760 | −0.6341 | 0.80 |
| 0.8485 | −0.5622 | 0.80 |
| 0.8206 | −0.4904 | 0.80 |
| 0.7924 | −0.4187 | 0.80 |
| 0.7638 | −0.3472 | 0.80 |
| 0.7346 | −0.2759 | 0.80 |
| 0.7051 | −0.2048 | 0.80 |
| 0.6749 | −0.1339 | 0.80 |
| 0.6442 | −0.0633 | 0.80 |
| 0.6127 | 0.0070 | 0.80 |
| 0.5805 | 0.0770 | 0.80 |
| 0.5474 | 0.1466 | 0.80 |
| 0.5133 | 0.2157 | 0.80 |
| 0.4782 | 0.2842 | 0.80 |
| 0.4416 | 0.3520 | 0.80 |
| 0.4035 | 0.4189 | 0.80 |
| 0.3636 | 0.4848 | 0.80 |
| 0.3217 | 0.5494 | 0.80 |
| 0.2773 | 0.6124 | 0.80 |
| 0.2301 | 0.6732 | 0.80 |
| 0.1796 | 0.7313 | 0.80 |
| 0.1252 | 0.7859 | 0.80 |
| 0.0668 | 0.8361 | 0.80 |
| 0.0040 | 0.8806 | 0.80 |
| −0.0632 | 0.9182 | 0.80 |
| −0.1344 | 0.9474 | 0.80 |
| −0.2089 | 0.9667 | 0.80 |
| −0.2854 | 0.9751 | 0.80 |
| −0.3623 | 0.9723 | 0.80 |
| −0.4380 | 0.9583 | 0.80 |
| −0.5110 | 0.9339 | 0.80 |
| −0.5803 | 0.9004 | 0.80 |
| −0.6452 | 0.8589 | 0.80 |
| −0.7053 | 0.8109 | 0.80 |
| −0.7608 | 0.7575 | 0.80 |
| −0.8117 | 0.6997 | 0.80 |
| −0.8586 | 0.6386 | 0.80 |
| −0.9016 | 0.5747 | 0.80 |
| −0.9413 | 0.5087 | 0.80 |
| −0.9782 | 0.4411 | 0.80 |
| −1.0120 | 0.3719 | 0.80 |
| −1.0421 | 0.3010 | 0.80 |
| −1.0681 | 0.2285 | 0.80 |
| −1.0883 | 0.1542 | 0.80 |
| −1.0995 | 0.0781 | 0.80 |
| −1.0914 | 0.0020 | 0.80 |
| −0.9953 | 0.0156 | 0.90 |
| −0.9206 | 0.0214 | 0.90 |
| −0.8509 | 0.0513 | 0.90 |
| −0.7839 | 0.0869 | 0.90 |
| −0.7167 | 0.1220 | 0.90 |
| −0.6478 | 0.1538 | 0.90 |
| −0.5768 | 0.1803 | 0.90 |
| −0.5036 | 0.2002 | 0.90 |
| −0.4287 | 0.2125 | 0.90 |
| −0.3530 | 0.2153 | 0.90 |
| −0.2777 | 0.2067 | 0.90 |
| −0.2046 | 0.1867 | 0.90 |

TABLE II-continued

| X Inches | Y Inches | Z % Span |
|---|---|---|
| −0.1351 | 0.1563 | 0.90 |
| −0.0700 | 0.1174 | 0.90 |
| −0.0093 | 0.0719 | 0.90 |
| 0.0473 | 0.0214 | 0.90 |
| 0.1003 | −0.0328 | 0.90 |
| 0.1503 | −0.0899 | 0.90 |
| 0.1976 | −0.1492 | 0.90 |
| 0.2426 | −0.2103 | 0.90 |
| 0.2856 | −0.2728 | 0.90 |
| 0.3270 | −0.3364 | 0.90 |
| 0.3670 | −0.4009 | 0.90 |
| 0.4057 | −0.4661 | 0.90 |
| 0.4433 | −0.5320 | 0.90 |
| 0.4799 | −0.5985 | 0.90 |
| 0.5157 | −0.6654 | 0.90 |
| 0.5509 | −0.7326 | 0.90 |
| 0.5854 | −0.8002 | 0.90 |
| 0.6194 | −0.8680 | 0.90 |
| 0.6529 | −0.9361 | 0.90 |
| 0.6861 | −1.0043 | 0.90 |
| 0.7190 | −1.0727 | 0.90 |
| 0.7517 | −1.1411 | 0.90 |
| 0.7842 | −1.2097 | 0.90 |
| 0.8166 | −1.2783 | 0.90 |
| 0.8490 | −1.3469 | 0.90 |
| 0.8813 | −1.4155 | 0.90 |
| 0.9141 | −1.4839 | 0.90 |
| 0.9482 | −1.5517 | 0.90 |
| 0.9953 | −1.6095 | 0.90 |
| 1.0688 | −1.6126 | 0.90 |
| 1.1186 | −1.5584 | 0.90 |
| 1.1127 | −1.4840 | 0.90 |
| 1.0901 | −1.4116 | 0.90 |
| 1.0661 | −1.3396 | 0.90 |
| 1.0417 | −1.2677 | 0.90 |
| 1.0171 | −1.1960 | 0.90 |
| 0.9924 | −1.1242 | 0.90 |
| 0.9677 | −1.0525 | 0.90 |
| 0.9427 | −0.9808 | 0.90 |
| 0.9176 | −0.9092 | 0.90 |
| 0.8923 | −0.8377 | 0.90 |
| 0.8668 | −0.7662 | 0.90 |
| 0.8411 | −0.6949 | 0.90 |
| 0.8151 | −0.6236 | 0.90 |
| 0.7888 | −0.5524 | 0.90 |
| 0.7621 | −0.4814 | 0.90 |
| 0.7351 | −0.4105 | 0.90 |
| 0.7077 | −0.3397 | 0.90 |
| 0.6799 | −0.2692 | 0.90 |
| 0.6516 | −0.1988 | 0.90 |
| 0.6228 | −0.1286 | 0.90 |
| 0.5934 | −0.0586 | 0.90 |
| 0.5633 | 0.0110 | 0.90 |
| 0.5326 | 0.0804 | 0.90 |
| 0.5010 | 0.1494 | 0.90 |
| 0.4685 | 0.2179 | 0.90 |
| 0.4348 | 0.2859 | 0.90 |
| 0.3999 | 0.3533 | 0.90 |
| 0.3636 | 0.4199 | 0.90 |
| 0.3256 | 0.4856 | 0.90 |
| 0.2857 | 0.5501 | 0.90 |
| 0.2434 | 0.6131 | 0.90 |
| 0.1983 | 0.6741 | 0.90 |
| 0.1499 | 0.7325 | 0.90 |
| 0.0977 | 0.7875 | 0.90 |
| 0.0413 | 0.8382 | 0.90 |
| −0.0197 | 0.8834 | 0.90 |
| −0.0854 | 0.9213 | 0.90 |
| −0.1554 | 0.9504 | 0.90 |
| −0.2288 | 0.9692 | 0.90 |
| −0.3042 | 0.9764 | 0.90 |
| −0.3799 | 0.9718 | 0.90 |
| −0.4540 | 0.9557 | 0.90 |
| −0.5250 | 0.9292 | 0.90 |
| −0.5920 | 0.8937 | 0.90 |
| −0.6543 | 0.8504 | 0.90 |

TABLE II-continued

| X Inches | Y Inches | Z % Span |
|---|---|---|
| −0.7116 | 0.8008 | 0.90 |
| −0.7640 | 0.7460 | 0.90 |
| −0.8119 | 0.6871 | 0.90 |
| −0.8556 | 0.6251 | 0.90 |
| −0.8956 | 0.5606 | 0.90 |
| −0.9325 | 0.4944 | 0.90 |
| −0.9664 | 0.4265 | 0.90 |
| −0.9969 | 0.3570 | 0.90 |
| −1.0233 | 0.2859 | 0.90 |
| −1.0444 | 0.2130 | 0.90 |
| −1.0566 | 0.1382 | 0.90 |
| −1.0498 | 0.0632 | 0.90 |
| −0.9757 | 0.0490 | 0.95 |
| −0.9016 | 0.0557 | 0.95 |
| −0.8324 | 0.0853 | 0.95 |
| −0.7656 | 0.1200 | 0.95 |
| −0.6982 | 0.1537 | 0.95 |
| −0.6290 | 0.1833 | 0.95 |
| −0.5575 | 0.2069 | 0.95 |
| −0.4839 | 0.2230 | 0.95 |
| −0.4091 | 0.2308 | 0.95 |
| −0.3339 | 0.2280 | 0.95 |
| −0.2602 | 0.2127 | 0.95 |
| −0.1899 | 0.1858 | 0.95 |
| −0.1242 | 0.1490 | 0.95 |
| −0.0634 | 0.1047 | 0.95 |
| −0.0068 | 0.0550 | 0.95 |
| 0.0460 | 0.0013 | 0.95 |
| 0.0958 | −0.0552 | 0.95 |
| 0.1428 | −0.1140 | 0.95 |
| 0.1877 | −0.1745 | 0.95 |
| 0.2306 | −0.2364 | 0.95 |
| 0.2719 | −0.2995 | 0.95 |
| 0.3117 | −0.3634 | 0.95 |
| 0.3503 | −0.4281 | 0.95 |
| 0.3879 | −0.4934 | 0.95 |
| 0.4245 | −0.5592 | 0.95 |
| 0.4603 | −0.6255 | 0.95 |
| 0.4954 | −0.6921 | 0.95 |
| 0.5298 | −0.7591 | 0.95 |
| 0.5638 | −0.8263 | 0.95 |
| 0.5973 | −0.8938 | 0.95 |
| 0.6304 | −0.9615 | 0.95 |
| 0.6633 | −1.0293 | 0.95 |
| 0.6958 | −1.0972 | 0.95 |
| 0.7282 | −1.1652 | 0.95 |
| 0.7604 | −1.2333 | 0.95 |
| 0.7925 | −1.3014 | 0.95 |
| 0.8246 | −1.3696 | 0.95 |
| 0.8567 | −1.4377 | 0.95 |
| 0.8891 | −1.5057 | 0.95 |
| 0.9227 | −1.5731 | 0.95 |
| 0.9698 | −1.6302 | 0.95 |
| 1.0428 | −1.6333 | 0.95 |
| 1.0942 | −1.5817 | 0.95 |
| 1.0881 | −1.5078 | 0.95 |
| 1.0656 | −1.4359 | 0.95 |
| 1.0421 | −1.3643 | 0.95 |
| 1.0182 | −1.2929 | 0.95 |
| 0.9942 | −1.2215 | 0.95 |
| 0.9701 | −1.1501 | 0.95 |
| 0.9460 | −1.0788 | 0.95 |
| 0.9217 | −1.0075 | 0.95 |
| 0.8972 | −0.9362 | 0.95 |
| 0.8726 | −0.8650 | 0.95 |
| 0.8477 | −0.7939 | 0.95 |
| 0.8227 | −0.7229 | 0.95 |
| 0.7974 | −0.6519 | 0.95 |
| 0.7718 | −0.5811 | 0.95 |
| 0.7459 | −0.5103 | 0.95 |
| 0.7197 | −0.4397 | 0.95 |
| 0.6932 | −0.3692 | 0.95 |
| 0.6662 | −0.2989 | 0.95 |
| 0.6388 | −0.2287 | 0.95 |
| 0.6110 | −0.1587 | 0.95 |
| 0.5826 | −0.0890 | 0.95 |

TABLE II-continued

| X Inches | Y Inches | Z % Span |
|---|---|---|
| 0.5535 | −0.0194 | 0.95 |
| 0.5238 | 0.0498 | 0.95 |
| 0.4934 | 0.1187 | 0.95 |
| 0.4621 | 0.1872 | 0.95 |
| 0.4298 | 0.2552 | 0.95 |
| 0.3963 | 0.3227 | 0.95 |
| 0.3616 | 0.3896 | 0.95 |
| 0.3254 | 0.4556 | 0.95 |
| 0.2875 | 0.5207 | 0.95 |
| 0.2476 | 0.5846 | 0.95 |
| 0.2051 | 0.6468 | 0.95 |
| 0.1596 | 0.7068 | 0.95 |
| 0.1105 | 0.7640 | 0.95 |
| 0.0575 | 0.8174 | 0.95 |
| −0.0001 | 0.8660 | 0.95 |
| −0.0625 | 0.9081 | 0.95 |
| −0.1297 | 0.9420 | 0.95 |
| −0.2010 | 0.9659 | 0.95 |
| −0.2752 | 0.9784 | 0.95 |
| −0.3505 | 0.9787 | 0.95 |
| −0.4248 | 0.9671 | 0.95 |
| −0.4966 | 0.9447 | 0.95 |
| −0.5647 | 0.9125 | 0.95 |
| −0.6281 | 0.8719 | 0.95 |
| −0.6864 | 0.8243 | 0.95 |
| −0.7397 | 0.7711 | 0.95 |
| −0.7882 | 0.7134 | 0.95 |
| −0.8323 | 0.6524 | 0.95 |
| −0.8726 | 0.5887 | 0.95 |
| −0.9095 | 0.5231 | 0.95 |
| −0.9435 | 0.4559 | 0.95 |
| −0.9742 | 0.3871 | 0.95 |
| −1.0010 | 0.3167 | 0.95 |
| −1.0225 | 0.2446 | 0.95 |
| −1.0355 | 0.1704 | 0.95 |
| −1.0299 | 0.0958 | 0.95 |

In this preferred embodiment of a first stage turbine bucket, there are ninety-two (92) bucket airfoils 36. The root of the bucket airfoil at the midpoint of the platform in a preferred embodiment of the turbine lies at 32.348 inches along a radius from the turbine centerline, i.e., the rotor axis. The actual height of the airfoil 36 in a preferred embodiment hereof, that is, the actual Z height of the bucket, is 7.075 inches from the root at the midpoint of the platform 30 to tip 33. Thus, the tip 33 of the bucket 16 in a preferred embodiment lies 39.423 inches along a radius from the turbine centerline 39. Thus, by defining the first stage bucket airfoil 36 and the plurality of internal air-cooling holes H1–H16 using X, Y and Z coordinates in a common Cartesian coordinate system, the airfoil and the locations of the cooling holes are defined relative to one another.

It will also be appreciated that the airfoil disclosed in the above Table II may be scaled up or down geometrically for use in other similar turbine designs. Consequently, the coordinate values set forth in Tables I and II may be scaled upwardly or downwardly such that the airfoil profile shape remains unchanged. A scaled version of the coordinates in Tables I and II would be represented by X and Y coordinate values of the Tables, and optionally the span locations coordinates of Table I and the non-dimensional z coordinate values of Table II when converted to inches, multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including a bucket airfoil having an airfoil shape and a plurality of cooling holes extending between root and tip portions thereof, said airfoil having a nominal profile substantially in accordance with Cartesian coordinate values of X, Y and Z set forth in Table II wherein the Z values are non-dimensional values from 0.05 span to 0.95 span convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, said holes including at least a first hole adjacent a leading edge, at least a second hole adjacent a trailing edge and a plurality of holes intermediate said leading and trailing edge holes, said plurality of intermediate holes including holes spaced from one another on opposite sides of a mean camber line between said leading and trailing edges wherein certain of said intermediate cooling holes form a generally airfoil-shaped envelope within and along the airfoil between said root and tip portions, said first, second and intermediate holes identified as holes numbered, H1, H16 and H2–H14, respectively, in Table I, holes being located in accordance with X and Y coordinate values set forth in Table I in a plane passing through the root of the airfoil section at 5% span.

2. A bucket according to claim 1 wherein said holes H2–H14 and H16 are located in accordance with X and Y coordinate values set forth in Table I in a plane passing through the airfoil at 50% span.

3. A bucket according to claim 1 wherein said holes H2–H14 and H16 are located in accordance with X and Y coordinate values set forth in Table I in a plane passing through the airfoil at 90% span.

4. A bucket according to claim 1 wherein said holes H2–H14 and H16 are located in accordance with X and Y coordinate values set forth in Table I in planes passing through the airfoil at 50% and 90% span, respectively.

5. A bucket according to claim 4 wherein said certain holes are defined in Table I as holes numbered H2–H11 at 5% span.

6. A bucket according to claim 4 wherein said certain holes are defined in Table I as holes numbered H2–H11 at 90% span.

7. A bucket according to claim 4 wherein said holes numbered H1–H14 and H16 in Table I have respective hole diameters as indicated in Table I.

8. A turbine bucket including a bucket airfoil having an airfoil shape and a plurality of cooling holes extending between root and tip portions thereof, said airfoil having a nominal profile substantially in accordance with Cartesian coordinate values of X, Y and Z set forth in Table II wherein the Z values are non-dimensional values from 0.05 span to 0.95 span convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, one of said holes extending adjacent a leading edge, at least a pair of holes extending adjacent a trailing edge and a plurality of holes extending intermediate said leading and trailing edge holes, said plurality of intermediate holes including holes spaced from one another on opposite sides of a mean camber line between said leading and trailing edges wherein certain of said intermediate cooling holes form a generally airfoil shaped envelope within and along the airfoil between said root and tip portions, said first hole, said pair of holes and said intermediate holes identified as holes numbered H1, H15 and H16, and H2–H14, respectively in Table I being located in accordance with X and Y coordinate values set forth in Table I in a plane passing through the root of the airfoil section at 5% span.

9. A bucket according to claim 8 wherein said holes H1–H16 are located in accordance with X and Y coordinate values set forth in Table I in a plane passing through the airfoil at 50% span.

10. A bucket according to claim 8 wherein said holes H1–H16 are located in accordance with X and Y coordinate values set forth in Table I in a plane passing through the airfoil at 90% span.

11. A bucket according to claim 8 wherein said holes H1–H16 are located in accordance with X and Y coordinate values set forth in Table I in a planes passing through the airfoil at 50% and 90% span, respectively.

12. A bucket according to claim 11 wherein said certain holes are defined in Table I as holes numbered H2–H11 at 5% span.

13. A bucket according to claim 11 wherein said certain holes are defined in Table I as holes numbered H1–H11 at 90% span.

14. A bucket according to claim 11 wherein said certain holes numbered H1–H16 in Table I have respective hole diameters as indicated in Table I.

* * * * *